US007765977B2

(12) United States Patent
Kurita et al.

(10) Patent No.: US 7,765,977 B2
(45) **Date of Patent: *Aug. 3, 2010**

(54) ENGINE COMPONENT PART AND METHOD FOR PRODUCING THE SAME

(75) Inventors: Hirotaka Kurita, Shizuoka (JP); Hiroshi Yamagata, Shizuoka (JP); Toshikatsu Koike, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 64 days.

This patent is subject to a terminal disclaimer.

(21) Appl. No.: 12/045,947

(22) Filed: Mar. 11, 2008

(65) Prior Publication Data

US 2008/0163846 A1 Jul. 10, 2008

Related U.S. Application Data

(63) Continuation of application No. 10/552,172, filed as application No. PCT/JP2005/003442 on Feb. 23, 2005, now Pat. No. 7,412,955.

(30) Foreign Application Priority Data

Feb. 27, 2004 (JP) ..... 2004-054582

(51) Int. Cl.
*F02B 75/22* (2006.01)

(52) U.S. Cl. ..... 123/195 R; 29/888.01

(58) Field of Classification Search ..... 123/195 R, 123/193.1–193.5; 29/888.01, 888.04, 888.047, 29/888.06
See application file for complete search history.

(56) References Cited

U.S. PATENT DOCUMENTS

| | | | | |
|---|---|---|---|---|
| 4,077,810 | A | 3/1978 | Ohuchi et al. | |
| 4,737,206 | A | 4/1988 | Iwai | |
| 5,131,356 | A * | 7/1992 | Sick et al. | 123/193.2 |
| 5,355,930 | A * | 10/1994 | Donahue et al. | 164/34 |
| 5,494,540 | A | 2/1996 | Ochi et al. | |
| 2004/0057865 | A1 | 3/2004 | Ikuno et al. | |

FOREIGN PATENT DOCUMENTS

| | | |
|---|---|---|
| CH | 665 223 A5 | 4/1988 |
| DE | 692 15 156 T2 | 6/1997 |
| DE | 103 33 103 A1 | 2/2004 |

(Continued)

OTHER PUBLICATIONS

Kurita et al.; "Engine Component Part and Method for Producing the Same"; U.S. Appl. No. 10/552,172, filed Oct. 5, 2005.

(Continued)

*Primary Examiner*—Noah Kamen
(74) *Attorney, Agent, or Firm*—Keating & Bennett, LLP

(57) ABSTRACT

An engine component is composed of an aluminum alloy containing silicon, and includes a plurality of primary-crystal silicon grains located on a slide surface. The plurality of primary-crystal silicon grains have an average crystal grain size of no less than about 12 μm and no more than about 50 μm.

10 Claims, 14 Drawing Sheets

FOREIGN PATENT DOCUMENTS

| | | | | |
|---|---|---|---|---|
| EP | 0 526 079 | B1 | | 11/1996 |
| FR | 2 825 376 | A1 | | 12/2002 |
| JP | 06-279904 | A | | 10/1994 |
| JP | 06-293933 | A | | 10/1994 |
| JP | 08-104937 | A | | 4/1996 |
| JP | 2000265232 | A | * | 9/2000 |

OTHER PUBLICATIONS

Communication of Notice of Opposition issued in the counterpart European Application No. 05719757.6, mailed on May 25, 2009.

Official Communication issued in corresponding European Patent Application No. 05719757.6, mailed on Dec. 14, 2009.

Official Communication issued in corresponding Japanese Patent Application No. 2005-047682, mailed on Dec. 25, 2009.

* cited by examiner

1°C/sec or Less
Average Grain Size : 56.5μm
Vacancy Ratio : 15%

10～20°C/sec
Average Grain Size : 30.3μm
Vacancy Ratio : 6.3%

40～50°C/sec
Average Grain Size : 22.5μm
Vacancy Ratio : 12.5%

4～10°C/sec
Average Grain Size : 32.0μm
Vacancy Ratio : 12.5%

25～30°C/sec
Average Grain Size : 23.8μm
Vacancy Ratio : 35%

ENGINE COMPONENT PART AND METHOD FOR PRODUCING THE SAME

BACKGROUND OF THE INVENTION

1. Field of the Invention

The present invention relates to an engine component, e.g., a cylinder block or a piston, and a method for producing the same. More particularly, the present invention relates to an engine component composed of an aluminum alloy which includes silicon, and a method for producing the same. The present invention also relates to an engine and an automotive vehicle incorporating such an engine component.

2. Description of the Related Art

In recent years, in an attempt to reduce the weight of engines, there has been a trend to use an aluminum alloy for cylinder blocks. Since a cylinder block is required to have a high strength and high abrasion resistance, aluminum alloys which contain a large amount of silicon are expected to be promising aluminum alloys for cylinder blocks.

In general, an aluminum alloy which contains a large amount of silicon is difficult to cast, thus making die casting-based mass production difficult. Accordingly, the inventors of the present invention have proposed a high-pressure die casting technique which enables mass production of cylinder blocks using such aluminum alloys (see the pamphlet of WO 2004/002658). This technique makes it possible to mass produce cylinder blocks which have sufficient abrasion resistance and strength for practical use.

However, depending on the conceivable engine revolution and the conceivable conditions under which an engine may be used, a cylinder block may meet with even higher abrasion resistance and strength requirements. For example, in the case of a motorcycle, its engine is operated at a revolution of 7,000 rpm or more, so that there exist fairly high abrasion resistance and strength requirements for the cylinder block.

SUMMARY OF THE INVENTION

In order to overcome the problems described above, preferred embodiments of the present invention provide an engine component which has excellent abrasion resistance and strength, as well as a method for producing such a novel engine component.

An engine component according to a preferred embodiment of the present invention is composed of an aluminum alloy containing silicon including a plurality of primary-crystal silicon grains located on a slide surface, wherein the plurality of primary-crystal silicon grains have an average crystal grain size of no less than about 12 μm and no more than about 50 μm. With this unique structure, the advantages and solutions described above are achieved.

In a preferred embodiment, the engine component further includes a plurality of eutectic silicon grains formed between the plurality of primary-crystal silicon grains, wherein the plurality of eutectic silicon grains have an average crystal grain size of no more than about 7.5 μm. With this unique structure, the advantages and solutions described above are achieved.

In a preferred embodiment, the engine component having the aforementioned structure is a cylinder block, wherein the plurality of primary-crystal silicon grains are exposed on a surface of a cylinder bore wall.

Alternatively, the engine component according to another preferred embodiment of the present invention is composed of an aluminum alloy containing silicon including a plurality of silicon crystal grains located on a slide surface, wherein the plurality of silicon crystal grains have a grain size distribution having at least two peaks; and the at least two peaks include a first peak existing in a crystal grain size range of no less than about 1 μm and no more than about 7.5 μm and a second peak existing in a crystal grain size range of no less than about 12 μm and no more than about 50 μm. With this unique structure, the advantages and solutions described above are achieved.

In a preferred embodiment, in any arbitrary rectangular region of the slide surface having an approximate size of 800 μm×1000 μm, the number of circular regions having a diameter of approximately 50 μm and not containing any silicon crystal grains of a crystal grain size of about 0.1 μm or more is equal to or less than five.

In a preferred embodiment, the aluminum alloy contains: no less than about 73.4 wt % and no more than about 79.6 wt % of aluminum; no less than about 18 wt % and no more than about 22 wt % of silicon; and no less than about 2.0 wt % and no more than about 3.0 wt % of copper.

In a preferred embodiment, the aluminum alloy contains: no less than about 50 wtppm and no more than about 200 wtppm of phosphorus; and no more than about 0.01 wt % of calcium.

In a preferred embodiment, the slide surface has a Rockwell hardness (HRB) of no less than about 60 and no more than about 80.

An engine according to a preferred embodiment of the present invention includes the engine component having the aforementioned structure. With this unique structure, the advantages and solutions described above are achieved.

A cylinder block according to a preferred embodiment of the present invention is a cylinder block composed of an aluminum alloy containing: no less than about 73.4 wt % and no more than about 79.6 wt % of aluminum; no less than 18 wt % and no more than about 22 wt % of silicon; and no less than about 2.0 wt % and no more than about 3.0 wt % of copper, the cylinder block including a plurality of primary-crystal silicon grains located on a slide surface arranged to come in contact with a piston, and a plurality of eutectic silicon grains disposed between the plurality of primary-crystal silicon grains, wherein, the plurality of primary-crystal silicon grains have an average crystal grain size of no less than about 12 μm and no more than about 50 μm, and the plurality of eutectic silicon grains have an average crystal grain size of no more than about 7.5 μm; the aluminum alloy contains: no less than about 50 wtppm and no more than about 200 wtppm of phosphorus; and no more than about 0.01 wt % of calcium; and the slide surface has a Rockwell hardness (HRB) of no less than about 60 and no more than about 80. With this unique structure, the advantages and solutions described above are achieved.

Alternatively, the cylinder block according to a preferred embodiment of the present invention is a cylinder block composed of an aluminum alloy containing: no less than about 73.4 wt % and no more than about 79.6 wt % of aluminum; no less than about 18 wt % and no more than about 22 wt % of silicon; and no less than about 2.0 wt % and no more than about 3.0 wt % of copper, the cylinder block including a plurality of silicon crystal grains formed on a slide surface to come in contact with a piston, wherein, the plurality of silicon crystal grains have a grain size distribution having at least two peaks; the at least two peaks include a first peak existing in a crystal grain size range of no less than about 1 μm and no more than about 7.5 μm and a second peak existing in a crystal grain size range of no less than about 12 μm and no more than about 50 μm; in any arbitrary rectangular region of the slide surface sized about 800 μm×1000 μm, the number of circular regions having a diameter of about 50 μm and not containing any silicon crystal grains of a crystal grain size of about 0.1 μm or more is equal to or less than five; the aluminum alloy contains: no less than about 50 wtppm and no more than about 200 wtppm of phosphorus; and no more than about 0.01 wt % of calcium; and the slide surface has a Rockwell hardness (HRB) of no less than about 60 and no more than about 80. With this unique structure, the advantages and solutions described above are achieved.

Alternatively, the engine according to a preferred embodiment of the present invention includes the cylinder block having the aforementioned structure; and a piston having a slide surface whose surface hardness is higher than that of the slide surface of the cylinder block. With this unique structure, the advantages and solutions described above are achieved.

An automotive vehicle according to yet another preferred embodiment of the present invention includes the engine having the aforementioned structure. With this unique structure, the advantages and solutions described above are achieved.

A method for producing a slide component for an engine according to a preferred embodiment of the present invention includes step (a) of preparing an aluminum alloy containing: no less than about 73.4 wt % and no more than about 79.6 wt % of aluminum; no less than about 18 wt % and no more than about 22 wt % of silicon; and no less than about 2.0 wt % and no more than about 3.0 wt % of copper; step (b) of cooling a melt of the aluminum alloy in a mold to form a molding; step (c) of subjecting the molding to a heat treatment at a temperature of no less than about 450° C. and no more than about 520° C. for a period of no less than about three hours and no more than about five hours, and thereafter liquid-cooling the molding; and step (d) of, after step (c), subjecting the molding to a heat treatment at a temperature of no less than about 180° C. and no more than about 220° C. for a period of no less than about three hours and no more than about five hours, wherein step (b) of forming the molding is performed so that an area of a slide surface is cooled at a cooling rate of no less than about 4° C./sec and no more than about 50° C./sec. With this unique structure, the advantages and solutions described above are achieved.

In a preferred embodiment, step (b) of forming the molding includes step (b-1) of allowing a plurality of primary-crystal silicon grains to be formed in the area of the slide surface so as to have an average crystal grain size of no less than about 12 μm and no more than about 50 μm; and step (b-2) of allowing a plurality of eutectic silicon grains to be formed between the plurality of primary-crystal silicon grains so as to have an average crystal grain size of no more than about 7.5 μm.

According to various preferred embodiments of the present invention, there is provided an engine component which has excellent abrasion resistance and strength, as well as a method for producing the same.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

The inventors have conducted a detailed study of the relationship between the mode or style of silicon crystal grains on a slide surface (i.e., a surface which comes in contact with a piston) of a cylinder block and the abrasion resistance and strength of the cylinder block. As a result, the inventors have discovered that the abrasion resistance and strength can be greatly improved by setting the average crystal grain size of the silicon crystal grains so as to fall within a specific range, and/or ensuring that the silicon crystal grains have a specific grain size distribution. The present invention has been developed based on this discovery information.

Moreover, the inventors have also investigated conditions for producing cylinder blocks, and thus arrived at a preferable production method which allows silicon crystal grains to be formed on the slide surface in the aforementioned preferable mode or style.

Hereinafter, preferred embodiments of the present invention will be described with reference to the drawings. Although the following description will mainly concern a cylinder block as an example, the present invention is not limited to such. The present invention can be suitably applied to a slide component for an engine, the slide component being a component (e.g., a cylinder block or a piston) of a combustion chamber of an internal combustion engine, and a method for producing the same.

Figure 1:
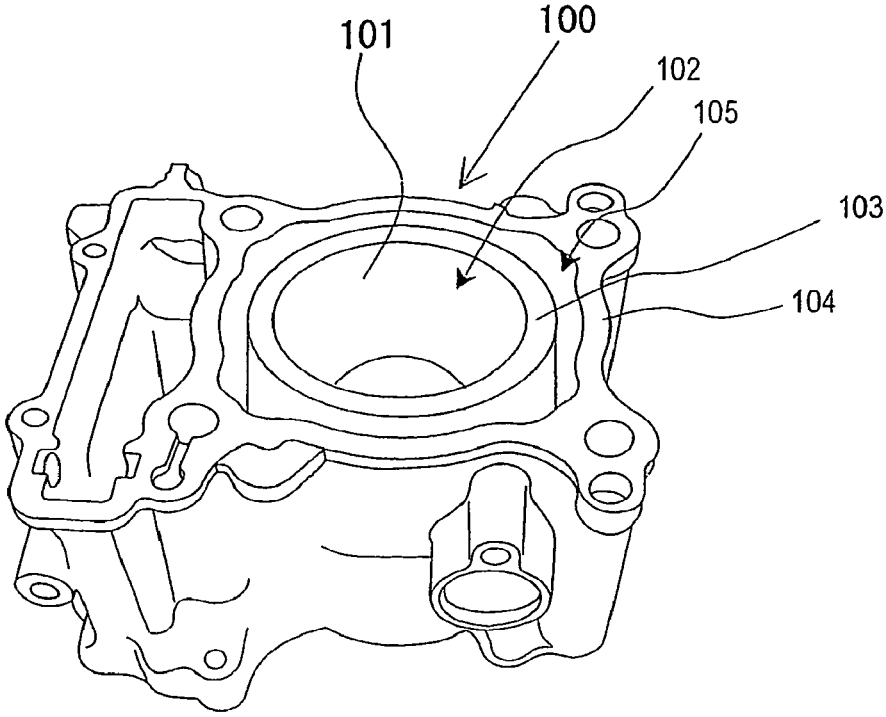
FIG. 1 is a perspective view schematically showing a cylinder block 100 according to a preferred embodiment of the present invention.

FIG. 1 shows a cylinder block 100 according to the present preferred embodiment. The cylinder block 100 is formed of an aluminum alloy which contains silicon.

As shown in FIG. 1, the cylinder block 100 preferably includes a wall portion (referred to as a "cylinder bore wall") 103 defining the cylinder bore 102, and a wall portion (referred to as a "cylinder block outer wall") 104 surrounding the cylinder bore wall 103 and defining the outer contour of the cylinder block 100. Between the cylinder bore wall 103 and the cylinder block outer wall 104, a water jacket 105 for retaining a coolant is provided.

The surface 101 of the cylinder bore wall 103 facing the cylinder bore 102 defines a slide surface which comes into contact with a piston. The slide surface 101 is shown enlarged in FIG. 2.

Figure 2:
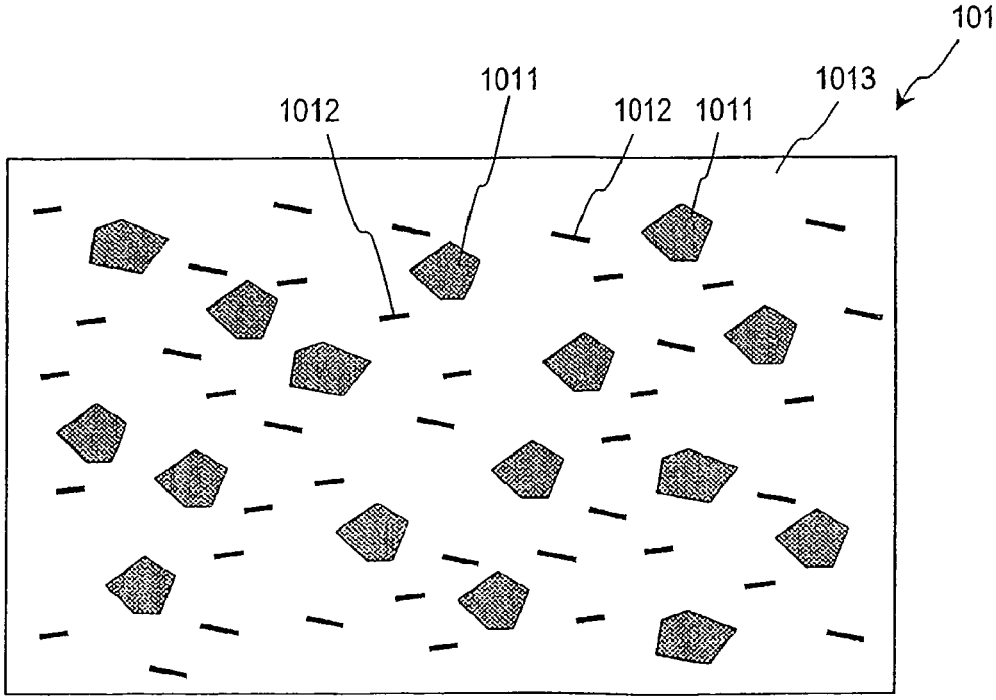
FIG. 2 is a schematic enlarged view of a slide surface of the cylinder block 100.

As shown in FIG. 2, the cylinder block 100 includes a plurality of silicon crystal grains 1011 and 1012, which have been formed and are located on the slide surface 101. These silicon crystal grains 1011 and 1012 are dispersed in a matrix 1013 of solid solution which contains aluminum.

The silicon crystal grains which are the first to crystallize when a melt of an aluminum alloy which has a hypereutectic composition containing a large amount of silicon are referred to as "primary-crystal silicon grains". The silicon crystal grains which crystallize then are referred to as "eutectic silicon grains". Among the silicon crystal grains 1011 and 1012 shown in FIG. 2, the relatively large silicon crystal grains 1011 are the primary-crystal silicon grains. The relatively small silicon crystal grains 1012 formed between the primary-crystal silicon grains are the eutectic silicon grains.

The eutectic silicon grains 1012 are typically needle-like crystals as shown in FIG. 2; however, not every eutectic silicon crystal grain 1012 is a needle-like crystal. In actuality, some of the eutectic silicon grains 1012 are likely to be granular crystals. The primary-crystal silicon grains 1011 are mainly composed of granular crystals, whereas the eutectic silicon grains 1012 are mainly composed of needle-like crystals.

The inventors have experimentally found that the abrasion resistance and strength of the cylinder block 100 can be greatly improved by prescribing the average crystal grain size of the primary-crystal silicon grains 1011 to be within a range of no less than about 12 μm and no more than about 50 μm. The detailed experimental results will be described later. For now, the reason why a considerable improvement of the abrasion resistance and strength can be achieved by setting the aforementioned range of average crystal grain size will be described with reference to FIGS. 3A to 3C.

Figure 3A:
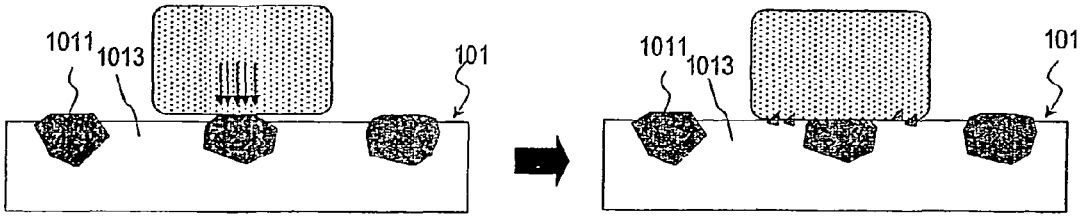
FIGS. 3A, 3B, and 3C are diagrams for explaining the relationship between an average crystal grain size of primary-crystal silicon grains and the abrasion resistance of a cylinder block.

If the average crystal grain size of the primary-crystal silicon grains 1011 exceeds about 50 μm, as shown at the left-hand side of FIG. 3A, the number of primary-crystal silicon grains 1011 per unit area of the slide surface 101 is small. Therefore, a large load is imposed on each primary-crystal silicon crystal grain 1011 during engine operation, so that, as shown at the right-hand side of FIG. 3A, the primary-crystal silicon grains 1011 may possibly be destroyed. If the primary-crystal silicon grains 1011 are destroyed, a film of lubricant which has been formed on the slide surface 101 will be broken, thus allowing a piston ring or piston to come into direct contact with the matrix 1013 of the slide surface 101, resulting in scuffs. Furthermore, the debris of the destroyed primary-crystal silicon grains 1011 will act as abrasive grains, thus causing considerable abrasion of the slide surface 101.

Figure 3B:
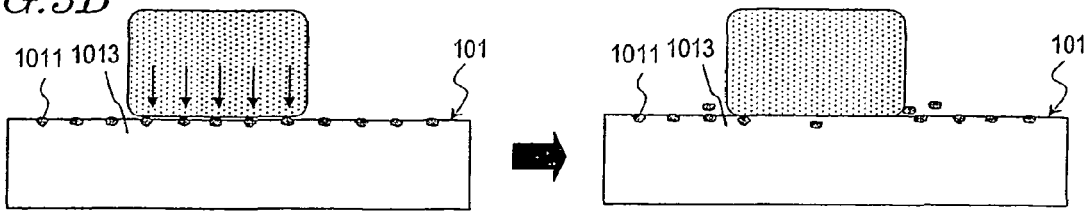

If the average crystal grain size of the primary-crystal silicon grains 1011 is less than about 12 μm, as shown at the left-hand side of FIG. 3B, only a small portion of each primary-crystal silicon crystal grain 1011 is buried in the matrix 1013. Therefore, as shown at the right-hand side of FIG. 3B, the primary-crystal silicon grains 1011 may easily be removed during engine operation. Such stray primary-crystal silicon grains 1011 will act as abrasive grains due to their high hardness, thus causing considerable abrasion of the slide surface 101. Moreover, the portion of each primary-crystal silicon crystal grain 1011 rising above the matrix 1013 is also small in this case, so that the thickness of the lubricant film to be retained on the slide surface 101 will be reduced. As a result, breaking of the lubricant film may easily occur, thus resulting in scuffs.

Figure 3C:
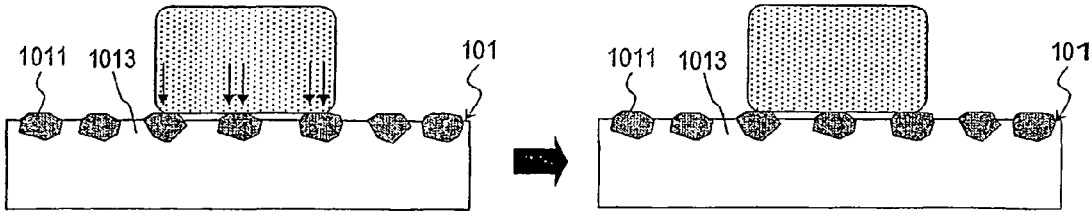

On the other hand, if the average crystal grain size of the primary-crystal silicon grains 1011 is no less than 12 μm and no more than about 50 μm, as shown at the left-hand side of FIG. 3C, an adequate number of primary-crystal silicon grains 1011 exist per unit area of the slide surface 101. Therefore, the load on each primary-crystal silicon crystal grain 1011 during engine operation becomes relatively small so that, as shown at the right-hand side of FIG. 3C, the primary-crystal silicon grains 1011 are prevented from being destroyed. Moreover, in this case, the portion of each primary-crystal silicon crystal grain 1011 rising above the matrix 1013 has a sufficient height, which makes possible the retention of a sufficient amount of lubricant. Thus, a lubricant film having a sufficient thickness can be retained on the slide surface 101, whereby breaking of the lubricant film, and hence generation of scuffs, can be prevented. Since the portion of each primary-crystal silicon crystal grain 1011 that is buried in the matrix 1013 is sufficiently large, the primary-crystal silicon grains 1011 are prevented from coming off. Therefore, abrasion of the slide surface 101 due to stray primary-crystal silicon grains can be prevented.

Moreover, the inventors studied how the eutectic silicon grains 1012 reinforce the matrix 1013 to discover that, by micronizing the eutectic silicon grains 1012, it is possible to improve the abrasion resistance and strength of the cylinder block 100. Specifically, improvement of abrasion resistance and strength can be obtained by ensuring that the eutectic silicon grains 1012 have an average crystal grain size of no more than about 7.5 μm.

Furthermore, the inventors have also examined the grain size distribution of the plurality of silicon crystal grains formed at the slide surface 101, to discover that a considerable improvement in the abrasion resistance and strength of the cylinder block 100 can be obtained by ensuring that the plurality of silicon crystal grains have a grain size distribution such that a peak exists in the crystal grain size range of no less than about 1 μm and no more than about 7.5 μm and another peak exists in the crystal grain size range of no less than about 12 μm and no more than about 50 μm.

With the cylinder block 100 of the present preferred embodiment of the present invention, as described above, the silicon crystal grains which are formed at the slide surface 101 achieve a high abrasion resistance, to such an extent that it is as if an anti-abrasion layer were formed at the inner surface of the cylinder bore wall 103. This "anti-abrasion layer" also improves the strength of the cylinder bore wall 103.

There is a known technique for improving the abrasion resistance of a cylinder block which involves placing a cylinder sleeve within the cylinder bore. However, with such a technique, it is difficult to ensure complete contact between the cylinder sleeve and the cylinder block itself, thus resulting in a deteriorated thermal conductivity. Moreover, the thickness of the cylinder sleeve itself adds to the overall thickness of the cylinder bore wall, thus deteriorating the cooling performance.

On the other hand, in accordance with the cylinder block 100 of the present preferred embodiment, an anti-abrasion layer, which also serves to provide an improved strength, is formed integrally with the cylinder bore wall 103. As a result, deterioration in thermal conductivity is prevented, and the thickness of the cylinder bore wall 103 itself can be reduced, thus making for an improved cooling performance. Furthermore, the improved cooling performance of the cylinder block 100 allows for an increase in the amount of gas mixture (which in the case of direct injection is air) that can be taken into the cylinder, whereby the engine output power can be enhanced.

Figure 4:
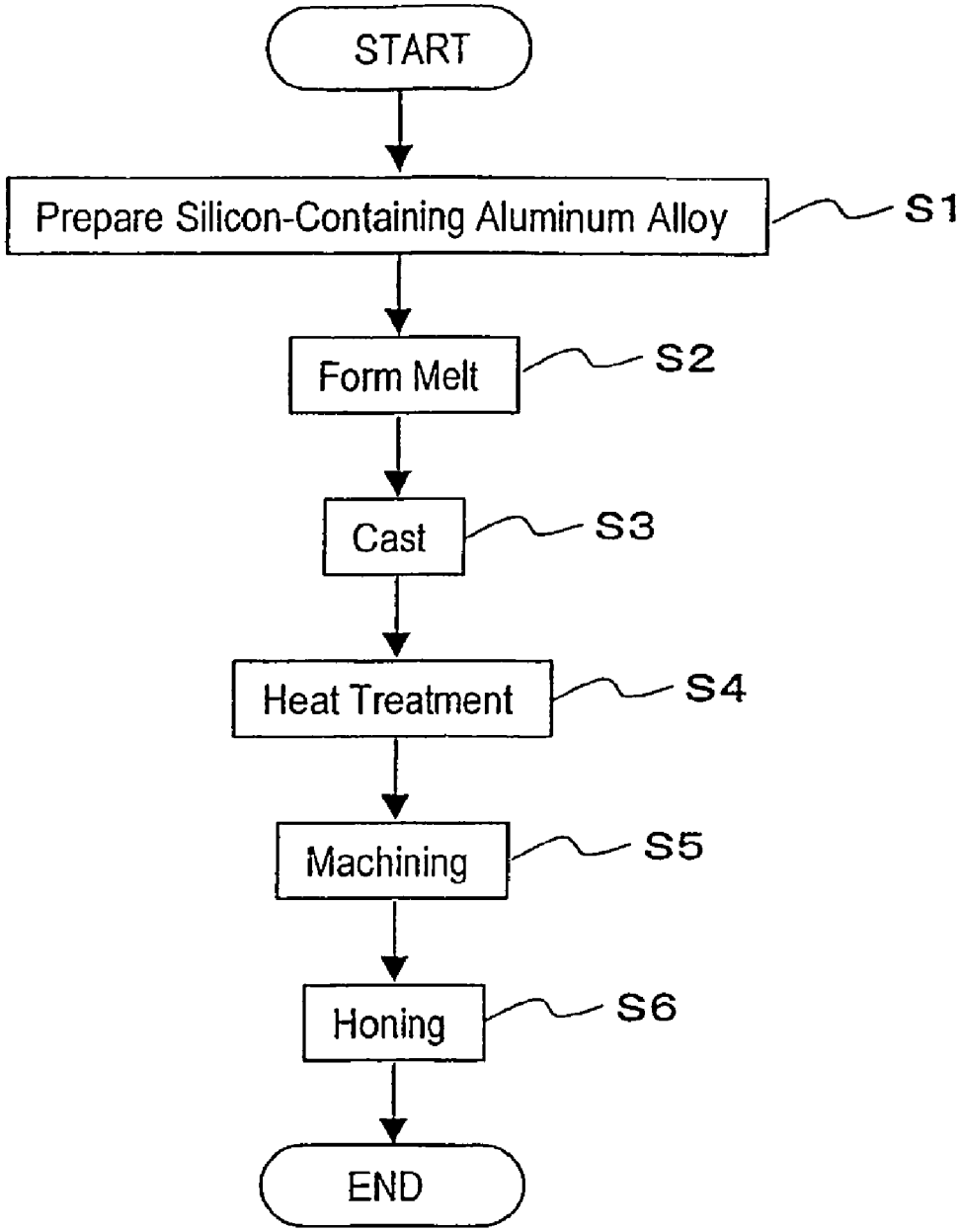
FIG. 4 is a flowchart illustrating a method for producing the cylinder block 100.

Next, a production method which can be suitably used for the production of the cylinder block 100 will be described with reference to FIG. 4. FIG. 4 is a flowchart illustrating a method for producing the cylinder block of the present preferred embodiment.

First, a silicon-containing aluminum alloy is prepared (step S1). In order to ensure a sufficient abrasion resistance and strength of the cylinder block 100, it is preferable to use an aluminum alloy which contains: no less than about 73.4 wt % and no more than about 79.6 wt % of aluminum; no less than about 18 wt % and no more than about 22 wt % of silicon; and no less than about 2.0 wt % and no more than about 3.0 wt % of copper. The aluminum alloy may be produced from a virgin bulk of aluminum, or from a recovered bulk of aluminum alloy.

Next, the prepared aluminum alloy is heated and melted in a melting furnace, whereby a melt is formed (step S2). At this time, in order to prevent any unmelted silicon from being left in the melt, the melt is heated to a predetermined temperature or higher. Once the aluminum alloy is completely melted, the melt is retained at a reduced temperature in order to prevent oxidation and gas absorption. It is preferable that phosphorus be added to the ingot or melt, at about 100 wtppm, before the melting. If the aluminum alloy contains no less than about 50 wtppm and no more than about 200 wtppm of phosphorus, it becomes possible to reduce the tendency of the silicon crystal grains to become gigantic, thus allowing for uniform dispersion of the silicon crystal grains within the alloy.

Next, casting is performed by using the aluminum alloy melt (step S3). In other words, the melt is cooled within a mold to form a molding. This step of molding formation is performed in such a manner that the area of the slide surface is cooled at a cooling rate of no less than about 4° C./sec and no more than about 50° C./sec. The specific structure of a cast apparatus to be used in this step will be described later.

Next, the cylinder block 100 which has been taken out of the mold is subjected to one of the heat treatments commonly known as "T5", "T6", and "T7" (step S4). A T5 treatment is a treatment in which the molding is rapidly cooled (with water or the like) immediately after being taken out of the mold, and thereafter subjected to artificial aging at a predetermined temperature for a predetermined period of time to obtain improved mechanical properties and dimensional stability, followed by air cooling. A T6 treatment is a treatment in which the molding is subjected to a solution treatment at a predetermined temperature for a predetermined period after being taken out of the mold, then cooled with water, and thereafter subjected to artificial aging at a predetermined temperature for a predetermined period of time, followed by air cooling. A T7 treatment is a treatment for causing a stronger degree of aging than in the T6 treatment; although the T7 treatment can ensure better dimensional stability than does the T6 treatment, the resultant hardness will be lower than that obtained from the T6 treatment.

Next, predetermined machining is performed for the cylinder block 100 (step S5). Specifically, a surface abutting with a cylinder head, a surface abutting with a crankcase, and the inner surface of the cylinder bore wall 103 are ground, turned, and so on.

Thereafter, the inner surface (i.e., a surface defining the slide surface 101) of the cylinder bore wall 103 is subjected to a honing process (step S6), whereby the cylinder block 100 is completed. A honing process can be performed, for example, in three steps of coarse honing, medium honing, and finish honing.

As described above, in accordance with the production method of the present preferred embodiment, the molding formation step is performed in such a manner that the area of the slide surface is cooled at a cooling rate of no less than about 4° C./sec and no more than about 50° C./sec. Therefore, as can be seen from a prototype cylinder block according to a preferred embodiment of the present invention which is described below, the average crystal grain size of the primary-crystal silicon grains 1011 formed on the slide surface 101 can be confined within the range of no less than about 12 μm and no more than about 50 μm. Moreover, as also seen from the below-described prototype, it is ensured that the average crystal grain size of the eutectic silicon grains 1012 formed between the primary-crystal silicon grains 1011 is equal to or less than about 7.5 μm. Thus, in accordance with the production method of the present preferred embodiment, a cylinder block 100 which has excellent abrasion resistance and strength can be produced.

As the heat treatment step, it is particularly preferable to perform a T6 treatment. Furthermore, it is preferable that the heat treatment step (T6 treatment step) include: a step of subjecting the molding to a heat treatment at a temperature of no less than about 450° C. and no more than about 520° C. for no less than about three hours and no more than about five hours, and then performing a liquid cooling (first heat treatment step); and a subsequent step of subjecting the molding to a heat treatment at a temperature of no less than about 180° C. and no more than about 220° C. for no less than about three hours and no more than about five hours (second heat treatment step).

The first heat treatment step allows any compound of aluminum and copper which exists within the alloy to be decomposed so that the copper atoms become dispersed within the matrix 1013, and the subsequent second heat treatment step allows these copper atoms to cohere within the matrix 1013. This cohesion state is also referred to as a coherent precipitation state. By effecting such a coherent precipitation of copper atoms within the matrix 1013, the strength of the matrix 1013 retaining the silicon crystal grains 1011 and 1012 is improved. Since the first heat treatment step allows the needle-like eutectic silicon grains 1012 to be dispersed within the matrix 1013, the supporting force (i.e., a force which supports the silicon crystal grains) of the matrix 1013 is improved, whereby an effect of preventing removal of the silicon crystal grains can also be attained.

Figure 5:
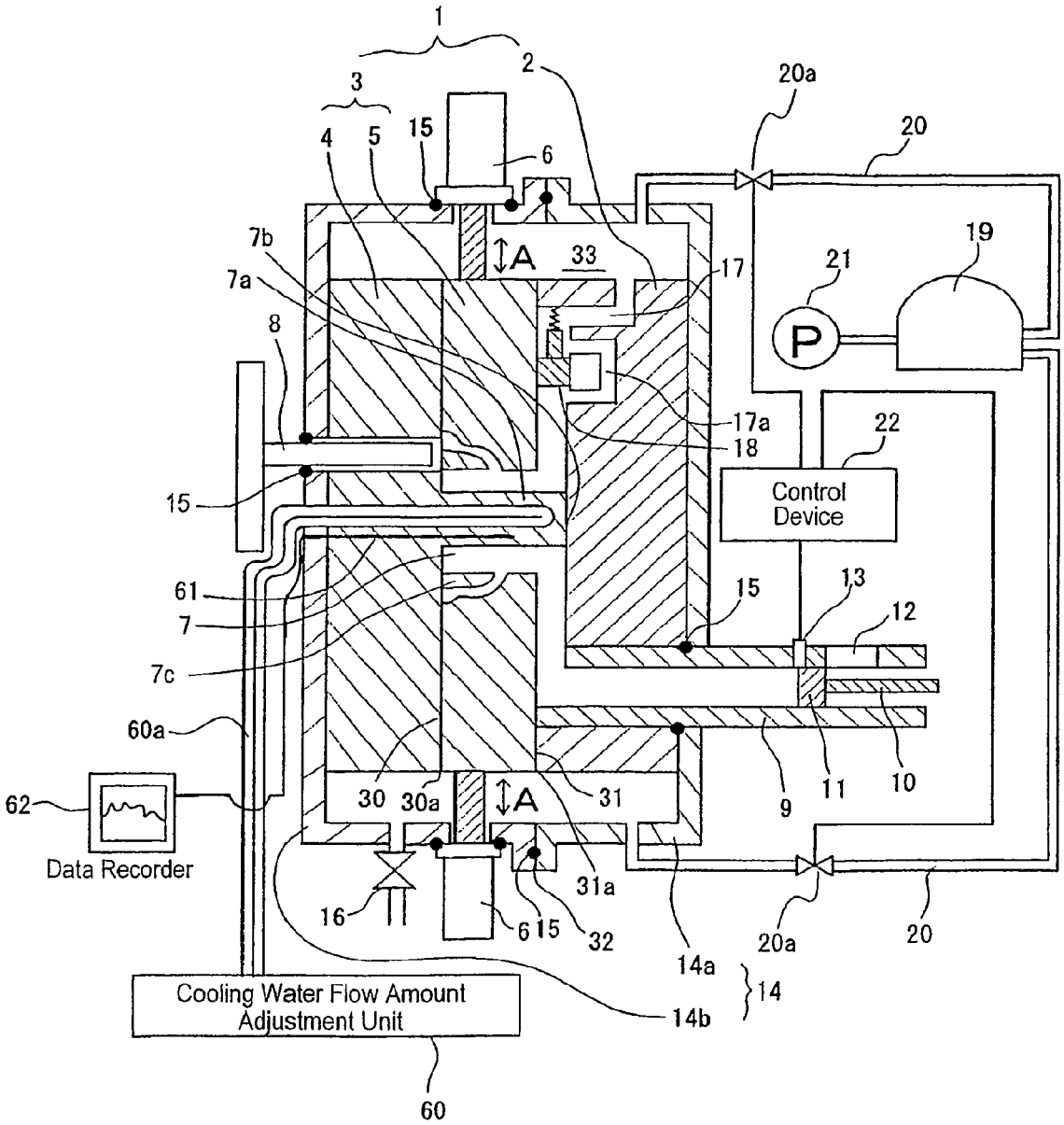
FIG. 5 is a schematic diagram showing a high-pressure die cast apparatus used for casting the cylinder block 100.

Now, a cast apparatus to be used for the casting process (step S3 in FIG. 4) will be described. FIG. 5 shows a high-pressure die cast apparatus used for the casting process. The high-pressure die cast apparatus shown in FIG. 5 includes a die 1 and a cover 14 which covers the entire die 1.

The die 1 is composed of a stationary die 2 which remains fixed, and a movable die 3 which has movable portions. The movable die 3 includes a base die 4 and a slide die 5. These dies are formed of a material which is selected with consideration to cooling efficiency; for example, these dies may be formed of an iron alloy (e.g., JIS-SKD61) to which silicon and vanadium have been added each at about 1%.

First, the die structure is described. The slide die 5 is split into four portions at every 90°, such that each split portion has a cylinder 6 (only two such cylinders 6 are shown in FIG. 5). By the action of the cylinder 6, each split portion of the slide die 5 slides along a direction denoted by arrow A in FIG. 5, upon a surface 30 of the base die 4 facing the slide die 5 (i.e., the abutting surface with the slide die 5), so as to form a cavity 7 corresponding to the cylinder block in a central portion at the time of casting.

In the central portion of the cavity 7, a cylinder bore forming portion 7*a* for forming a cylinder bore is provided. In the illustrated high-pressure die cast apparatus, the cylinder bore forming portion 7*a* is formed so as to be integral with the base die 4; at casting, a tip 7*b* thereof abuts with a surface of the stationary die 2 facing the movable die 3, as shown. Within the cavity 7, a core 7*c* for forming a water jacket is provided. The core 7*c* is formed separately from the base die 4, and thus is removable therefrom.

The base die 4 is provided with an extrusion pin 8. For each shot, a molding is extruded by the extrusion pin 8, with the slide die 5 being open, whereby the molding is taken out from the die 1.

Next, a melt-feeding system will be described. The stationary die 2 is provided with an injection sleeve 9. Within the injection sleeve 9, a plunger tip 11 which is provided at the tip end of a rod 10 reciprocates. A melt-feeding inlet 12 is formed in the injection sleeve 9. While the plunger tip 11 is in an original position (i.e., "behind", or to the right (as shown in FIG. 5) of the melt-feeding inlet 12), one shot's worth of melt is injected through the melt-feeding inlet 12. Ahead of the melt-feeding inlet 12 is provided a tip sensor 13. The tip sensor 13 detects passage of the plunger tip 11 past the melt-feeding inlet 12. As the plunger tip 11 extrudes the melt, the cavity 7 is filled with the melt.

The cover 14 includes a first cover element 14*a* for accommodating the stationary die 2 and a second cover element 14*b* for accommodating the movable die 3. In order to maintain air tightness within the cover 14, a sealing member 15, such as an O ring, is mounted on a surface 32 of the first cover element 14*a* that abuts with the second cover element 14*b*. A sealing member 15 such as an O ring is also mounted at any interspace between the cover 14 and each of the cylinder 6, the extrusion pin 8, and the injection sleeve 9 penetrating through the cover 14. A leak valve 16 for exposing the interior of the cover 14 to the atmosphere is provided on the second cover element 14*b*. Alternatively, the leak valve 16 may be provided on the first cover element 14*a*.

In the stationary die 2, a ventilation passage 17 which communicates with the cavity 7 is formed. Within the ventilation passage 17, an ON/OFF valve 18 is provided, with a bypass passage 17*a* being formed so as to avoid the portion where the ON/OFF valve 18 is provided. The bypass passage 17*a* is provided in order to allow the ventilation passage 17 to communicate with the exterior of the die 1 when a vacuum suction is performed in the die 1 at casting (i.e., in the state as shown in FIG. 5). The bypass passage 17*a* and the ventilation passage 17 are closed or opened as the ON/OFF valve 18 moves in the upper or lower direction in FIG. 5. The ON/OFF valve 18 is energized with a spring so that the passage normally stays open. Alternatively, the ventilation passage 17 may be formed on the movable die 3.

The ON/OFF valve 18 is a valve of a metal-touch type, for example. Once the cavity 7 is filled with melt, the excess melt will move up the ventilation passage 17, until the melt touches the ON/OFF valve 18 so as to push up the ON/OFF valve 18. As a result, the bypass passage 17*a* is closed together with the ventilation passage 17, thus preventing the melt from spurting out of the die 1.

Instead of such a metal-touch type valve, a valve may alternatively be used which detects the position of the plunger tip 11 and closes the ventilation passage 17, by an actuator, when thrusting of one shot of melt is completed.

Alternatively, a chill-vent structure may be used to prevent the melt from spurting out. In a chill-vent structure, a thin, elongated passage of a zigzag shape is formed to communicate with the cavity 7. Any melt that overflows the cavity 7 is allowed to solidify midway through this passage, whereby the melt is prevented from spurting out of the die 1.

In order to minimize the amount of air which strays into the molding, it is necessary to place the interior of the cavity 7 in a decompressed state prior to feeding of the melt. To the cover 14 (or more specifically, the first cover element 14*a* in this example), one or more (i.e., two in this example) vacuum ducts 20 which communicate with a vacuum tank 19 are connected. The vacuum tank 19 is maintained at a predetermined vacuum pressure by a vacuum pump 21. A solenoid valve 20*a* which is installed in each vacuum duct 20 is controlled by a control device 22 so as to be opened or closed. Specifically, the control device 22 controls the opening/closing in accordance with the start/end timing of decompression of the cavity 7, based on a detection signal of a stroke position of the plunger tip 11, a timer signal concerning stroke time, or the like.

Although the present preferred embodiment illustrates an example where the cover 14 covers the entire die 1, the cover 14 may alternatively cover only a portion of the die 1. For example, an outer periphery of the die 1 may be covered in an annular fashion, along peripheries 30*a* and 31*a*, respectively, of the abutting surface 30 of the base die 4 with the slide die 5 and the abutting surface 31 of the slide die 5 with the stationary die 2. Alternatively, a cover shaped so as to cover the cylinder 6 for driving the slide die 5 may be provided.

Thus, in accordance with the high-pressure die cast apparatus of the present preferred embodiment, the cover 14 is arranged so as to cover the die 1, and the interior of the cover 14 is evacuated. By thus decompressing the interior of the cavity 7, casting is performed. Therefore, even in the case where the slide die 5 is split into a large number of portions, it is still possible to perform a vacuum suction for the entire die 1, without having to provide sealing for the die 1 itself. Since a vacuum suction for the cavity 7 is performed also from the interspace between the abutting surfaces 30 and 31, a high degree of vacuum can be achieved, thus enabling a more reliable gas removal from within the die 1. Since the sealing member 15 between the first cover element 14*a* and the second cover element 14*b* is mounted at a distant position from the die 1, which in itself is bound to rise to a high temperature, the thermal influence from the die 1 is small. Thus, deterioration of the sealing member 15 is prevented, and durability is improved.

A cooling water flow amount adjustment unit 60 controls cooling of the die 1 during the casting process. The cooling of the die 1 is carried output by allowing cooling water to flow through a cooling water passage 60*a*, which is formed in the base die 4. Specifically, with the timing of the high-speed injection by the plunger tip 11, a valve (not shown) is opened to allow cooling water to flow for a certain period of time (e.g., a period of time until the die is opened and the molding is taken out).

The cooling water flow amount adjustment unit 60 in the present preferred embodiment is also able to control the cooling rate of the cylinder bore forming portion 7*a* of the die 1. In the present preferred embodiment, the cooling water passage 60*a* extends into the interior of the cylinder bore forming portion 7*a*, thus making it possible to control the cooling rate of the cylinder bore forming portion 7*a* by controlling the amount of cooling water. Therefore, it is possible to cool the area of the slide surface of the molding (i.e., a portion of the melt located near the slide surface) at a desired cooling rate.

As already described, by cooling the area of the slide surface at a cooling rate of no less than about 4° C./sec and no more than about 50° C./sec, it is ensured that the average crystal grain size of the primary-crystal silicon grains 1011 falls within the range of no less than about 12 μm and no more than about 50 μm, and that the average crystal grain size of the eutectic silicon grains 1012 is equal to or less than about 7.5 μm.

The controlling of the cooling rate may be performed, as shown in FIG. 5, for example, by detecting temperature of the neighborhood of the slide surface by a temperature sensor 61 which is placed inside the cylinder bore forming portion 7*a* of the base die 4, and adjusting the flow amount of the cooling water so as to equal a desired cooling rate while monitoring the actual temperature through temperature management by a data recorder 62. If the cooling rate is too fast, the silicon crystal grains will not grow to a grain size which can realize sufficient abrasion resistance. Therefore, the cooling is preferably performed in such a manner that a relatively slow cooling rate is initially used, and a faster cooling rate is used to stop growth immediately before the silicon crystal grains become gigantic.

Before beginning casting, the slide die 5 is placed in a predetermined place, and thereafter the movable die 3 is abutted against the stationary die 2 to close the die, whereby the cavity 7 is formed. At this time, the inside of the cover 14 is sealed upon abutment of the first cover element 14*a* against the second cover element 14*b*, with the sealing member 15 interposed therebetween. By thus performing the die-closing step (of abutting together the stationary die 2 and the movable die 3 to form the cavity 7) simultaneously with the sealing step (of covering the die 1 with the cover 14 to effect sealing), the cast cycle time can be reduced. Note however that these steps do not need to be performed simultaneously. Alternatively, the stationary die 2 and the movable die 3 may be first closed together to form the cavity 7, and thereafter the die 1 may be covered with the cover 14 to effect sealing.

Now, the operation of the high-pressure die cast apparatus shown in FIG. 5 will be described in chronological order (from time t0 to time t6).

Time t0: The plunger tip 11 is in its original position ("behind" the melt-feeding inlet 12), and the melt-feeding inlet 12 is open. The interior of the die 1 is exposed to the atmosphere via the melt-feeding inlet 12. In this state, one shot worth of aluminum alloy melt is injected into the injection sleeve 9 from the melt-feeding inlet 12. After the melt is injected, the plunger tip 11 moves forward at a slow speed, thus thrusting forward the melt in the injection sleeve 9.

Time t1: The tip sensor 13 detects the plunger tip 11. Since the plunger tip 11 is situated ahead of the melt-feeding inlet 12 in this state, the interior of the cover 14 is being sealed in a completely air tight manner. At this point, the solenoid valve 20*a* is driven to evacuate the interior of the cover 14.

This evacuation is performed so that evacuation of a space 33 between the die 1 and the cover 14 and evacuation of the cavity 7 occur simultaneously. Therefore, an efficient decompression step is carried out, whereby the cast cycle time is reduced.

Note that an evacuation path for the cavity 7 may be distinct from an evacuation path for the space 33 between the die 1 and the cover 14, such that the two evacuations are performed with different timings. For example, if the space 33 between the die 1 and the cover 14 is evacuated before the cavity 7, any liquid release agent which may have strayed into and adhered to interspaces such as the abutting surface of the die 1 and the surface of the slide die 5 facing the slide surface can be directly sucked toward the space 33, without being sucked into the cavity 7. Therefore, excess release agent is prevented from flowing into the cavity 7 and mixing with the melt, whereby defects such as pinholes can be prevented.

Through the evacuation as described above, the interior of the cavity 7 of the die 1 is decompressed, whereby the degree of vacuum is gradually increased. The plunger tip 11 keeps moving forward at a slow speed, thrusting the melt toward the cavity 7. If evacuation is begun after the plunger tip 11 has moved past the melt-feeding inlet 12, atmospheric air is prevented from being sucked into the die 1 via the melt-feeding inlet 12. As a result, occurrence of pinholes can be prevented with an increased certainty, and the melt surface is prevented from being locally cooled by the atmospheric air, so that a cast article with uniform and stable quality can be obtained.

Time t2: The progression speed of the plunger tip 11 is switched from slow to fast when the melt has reached the inlet of the cavity 7, after which the melt is rapidly supplied into the cavity 7.

Time t3: The cavity 7 is completely filled with the melt, whereby injection is completed. Since the melt pushes up the ON/OFF valve 18 of the ventilation passage 17 at this time, the melt is prevented from spurting out of the ventilation passage 17. At the time when a high-speed injection is performed with the plunger tip 11, cooling water is allowed to flow through the cooling water passage 60*a* which is provided inside the cylinder bore forming portion 7*a*, so that the area of a portion of the melt to become the slide surface (i.e., the surface facing the cylinder bore) is cooled at a cooling rate of no less than about 4° C./sec and no more than about 50° C./sec.

Time t4: The vacuum pump 21 is stopped, and the decompression through evacuation is completed. At this point, the interior of the cover 14 is still in a decompressed state.

Time t5: The leak valve 16 is opened to expose the interior of the cover 14 to the atmosphere. As atmospheric air flows in through the leak valve 16, the air pressure inside the cover 14 becomes closer to the atmospheric pressure with lapse of time.

Time t6: The air pressure inside the cover 14 completely returns to the atmospheric pressure. At this point, the die 1 is opened, and the molding (cast article) is taken out.

By using the above-described production method, the cylinder block 100 shown in FIG. 2 was actually prototyped, and its abrasion resistance and strength were evaluated. Portions of the results are shown below. As the aluminum alloy, an aluminum alloy of a composition shown in Table 1 was used.

TABLE 1

| Si | Cu | Mg |
|---|---|---|
| 20 wt % | 2.5 wt % | 0.5 wt % |
| Fe | P | Al |
| 0.5 wt % | 200 wtppm | remainder |

As silicon, high-purity silicon was used. The calcium content in the aluminum alloy was equal to or less than about 0.01 wt %. As a method of slag removal at the time of melting, only argon gas bubbling was performed, and the sodium content in the aluminum alloy was equal to or less than about 0.1 wt %. By ensuring that the calcium and sodium contents are equal to or less than about 0.01 wt % and equal to or less than about 0.1 wt %, respectively, the silicon crystal grain micronization effect of phosphorus can be conserved, and a metallographic structure which has excellent abrasion resistance can be obtained.

By using the aluminum alloy of the aforementioned composition, casting was performed by the high-pressure die cast apparatus shown in FIG. 5. Cooling of the cylinder bore forming portion 7*a* was performed by allowing cooling water to flow through the cooling water passage 60*a* while detecting temperature with the temperature sensor 61, so that the cooling rate was no less than about 25° C./sec and no more than about 30° C./sec, until the temperature came in the range of no less than about 400° C. and no more than about 500° C. The cylinder block which was taken out of the die 1 was subjected to a heat treatment (solution treatment) at about 490° C. for about 4 hours, then cooled with water, and further subjected to a heat treatment (aging process) at about 200° C. for about 4 hours. Thereafter, a honing process was performed for the cylinder block.

For comparison, casting was also performed by using an aluminum alloy of the same composition, by a sand mold and without cooling the cylinder bore forming portion. After the sand mold casting, a solution treatment, an aging process, and a honing process similar to those performed for the prototype were performed.

Figure 6A:
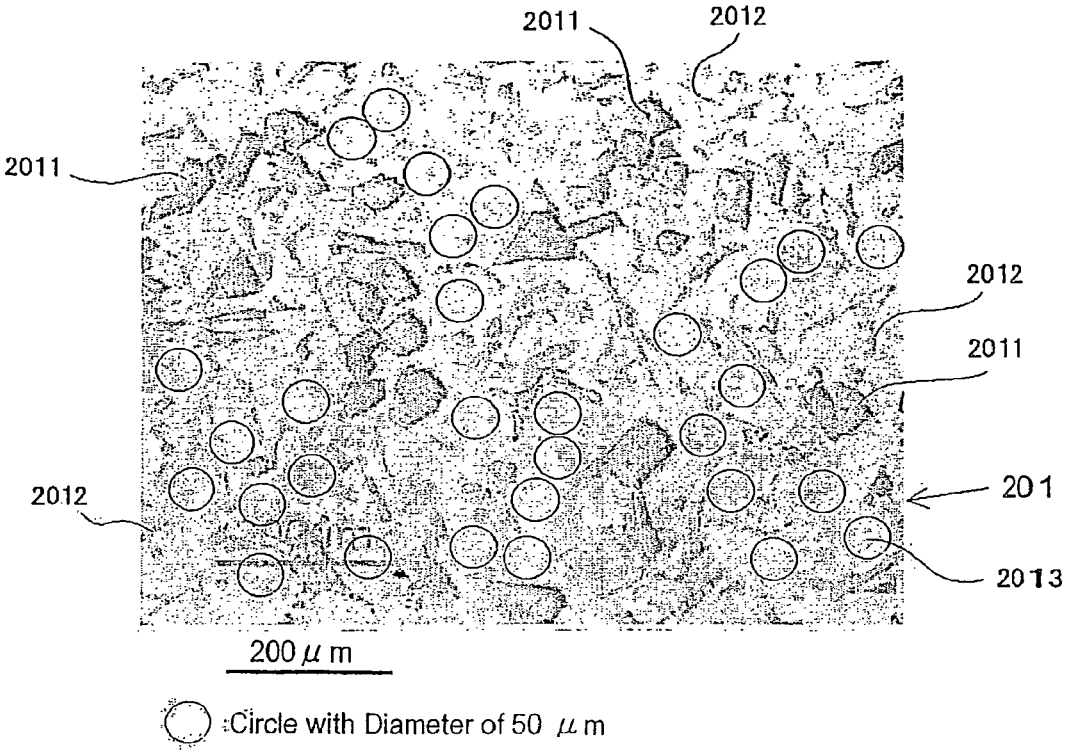
FIGS. 6A and 6B are metallurgical microscope photographs of a slide surface of a comparative cylinder block, which was cast by using a sand mold.
Figure 6B:
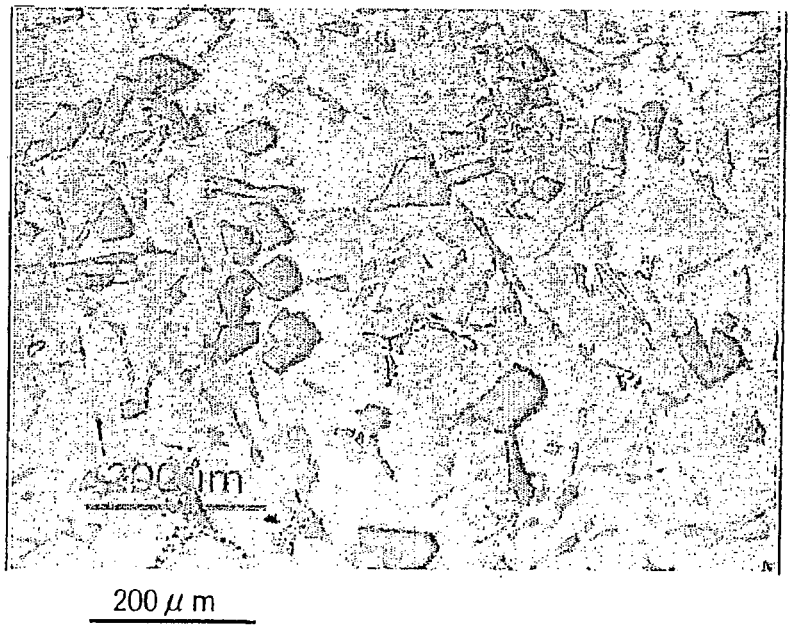
Figure 7A:
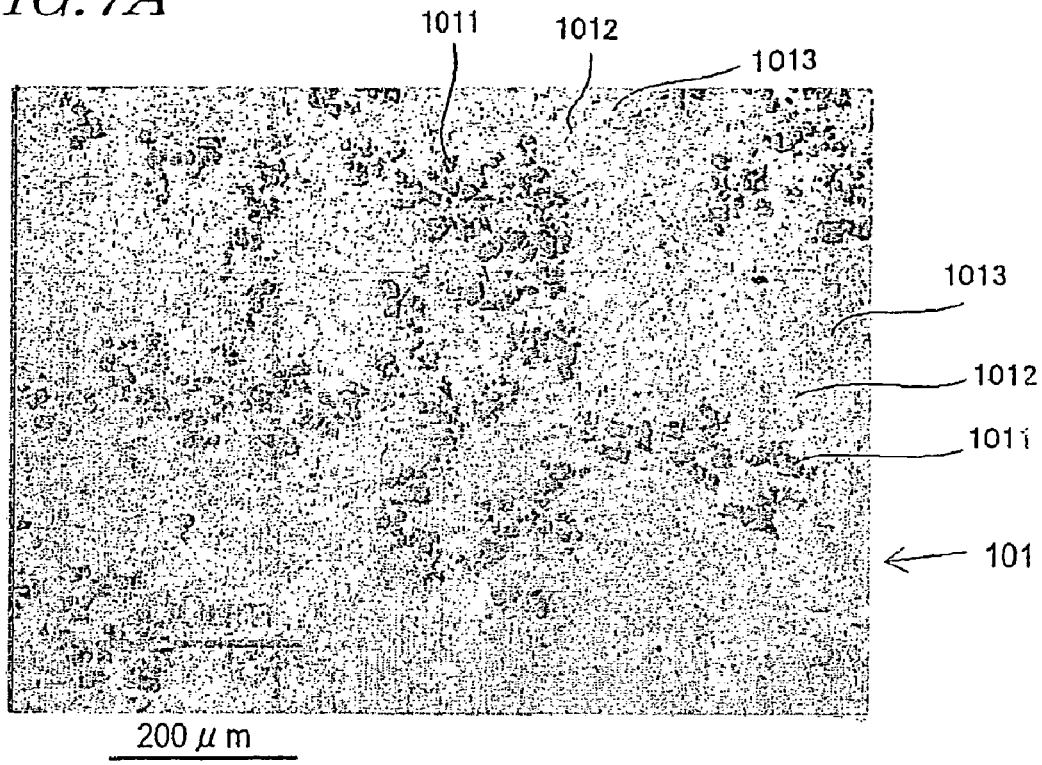
FIGS. 7A and 7B are metallurgical microscope photographs of a slide surface of a prototype cylinder block, which was cast via high-pressure die cast.
Figure 7B:
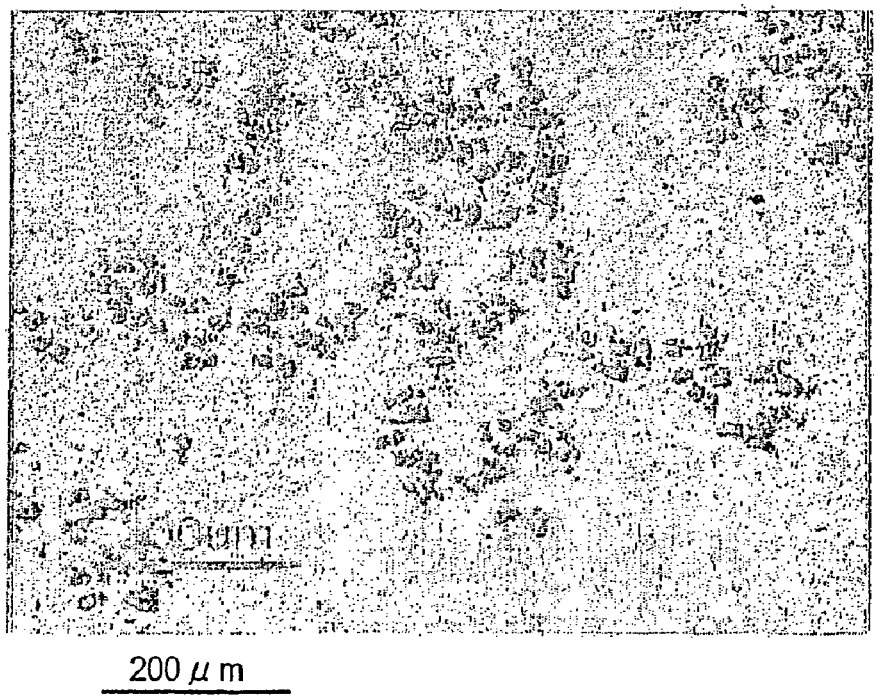

With respect to the resultant prototype and comparative cylinder blocks, their slide surfaces were observed with a metallurgical microscope. FIGS. 6A and 6B and FIGS. 7A and 7B show metallurgical microscope photographs of the respective slide surfaces. FIGS. 6A and 6B show the slide surface 201 of the comparative example, which was cast by a sand mold. FIGS. 7A and 7B show the slide surface 101 of the prototype, which was cast by high-pressure die cast. Note that reference numerals are added in FIG. 6A and FIG. 7A, and circles with a diameter of about 50 μm are shown in FIG. 6A.

As seen from FIGS. 6A and 6B, on the slide surface 201 of the comparative example, a large number of primary-crystal silicon grains 2011 with grain sizes over about 50 μm are present. On the other hand, as seen from FIGS. 7A and 7B, the primary-crystal silicon grains 1011 on the slide surface 101 of the prototype have grain sizes of about 50 μm or less, thus indicating that, as compared to the comparative example, minute primary-crystal silicon grains 1011 are uniformly distributed.

Furthermore, it can be seen that the eutectic silicon grains 1012 (which are mainly of a needle-like shape, with only some being granular) which have formed on the slide surface 101 of the prototype are finer than the eutectic silicon grains 2012 (most of which are of a needle-like shape) which have formed on the slide surface 201 of the comparative example.

With respect to both the comparative example and the prototype, an average crystal grain size of the silicon crystal grains was calculated. The "grain size" as used herein is the diameter of a corresponding circle. Surface data of a target area was input to a computer, and an average crystal grain size was calculated by using commercially-available software (win ROOF from Mitani Corporation).

The primary-crystal silicon grains 2011 on the slide surface 201 of the comparative example had an average crystal grain size of about 60 μm or more. On the other hand, the primary-crystal silicon grains 1011 on the slide surface 101 of the prototype had an average grain size of about 24 μm. Furthermore, the eutectic silicon grains 1012 on the slide surface 101 of the prototype had an average crystal grain size of about 6.4 μm.

The slide surface 201 of the comparative example had a vacancy ratio (defined as a ratio of the area of an aluminum solid solution 2013 containing copper and the like to the overall area of the slide surface 201) of about 15%. On the other hand, the slide surface 101 of the prototype had a vacancy ratio (defined as a ratio of the area of an aluminum solid solution 1013 containing copper and the like to the overall area of the slide surface 101) of about 35%.

With respect to both the comparative example and the prototype, in an arbitrary rectangular region of the slide surface having an area of approximately 800 m×1000 μm, the number of circular regions with a diameter of about 50 μm which did not contain any silicon crystal grains of a crystal grain size of about 0.1 μm or more was counted by visual inspection. It was confirmed that this number was five or less for the prototype. On the other hand, many such circular regions exist in the comparative example, as is clear from FIG. 6A. Thus, it can be seen that the silicon crystal grains on the slide surface are dispersed more uniformly in the prototype than in the comparative example.

Figure 8:
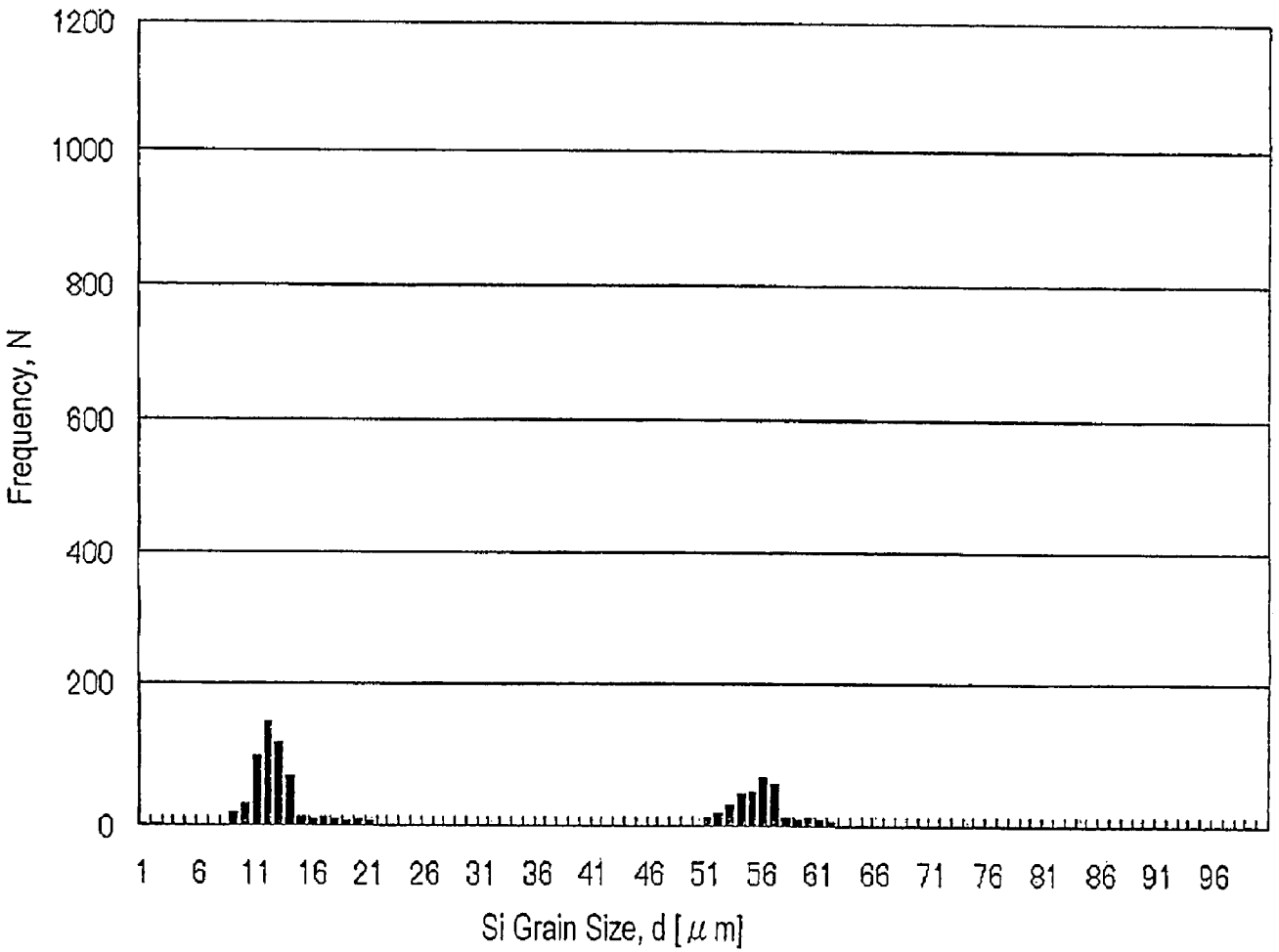
FIG. 8 is a graph showing a grain size distribution of silicon crystal grains formed on the slide surface of the comparative cylinder block.
Figure 9:
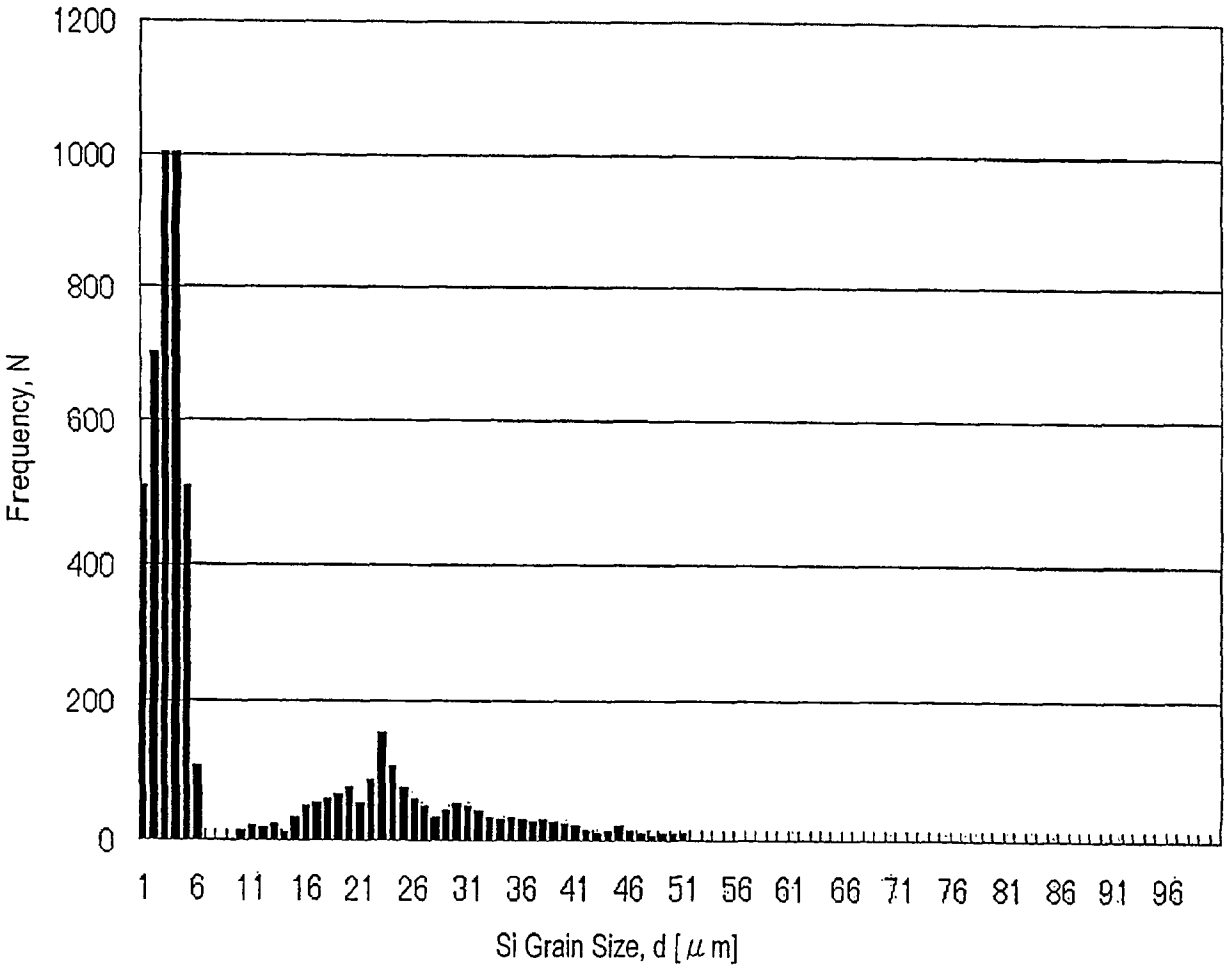
FIG. 9 is a graph showing a grain size distribution of silicon crystal grains formed on the slide surface of the prototype cylinder block.

With respect to both the comparative example and the prototype, a grain size distribution of the silicon crystal grains on the slide surface was examined. The results are shown in FIGS. 8 and 9. FIG. 8 is a graph for the comparative example, which was cast by a sand mold. FIG. 9 is a graph for the prototype, which was cast by high-pressure die cast.

As can be seen from FIG. 8, the silicon crystal grains which have formed on the slide surface 201 of the comparative example have a grain size distribution such that a peak exists in the crystal grain size range of no less than about 10 μm and no more than about 15 μm and another peak exists in the crystal grain size range of no less than about 51 μm and no more than about 63 μm. The silicon crystal grains whose crystal grain sizes fall within the range of no less than about 10 μm and no more than about 15 μm are eutectic silicon grains, whereas the silicon crystal grains whose crystal grain sizes fall within the range of no less than about 51 μm and no more than about 63 μm are primary-crystal silicon grains.

On the other hand, as can be seen from FIG. 9, the silicon crystal grains which have formed on the slide surface 101 of the prototype have a grain size distribution such that a peak exists in the crystal grain size range of no less than about 1 μm and no more than about 7.5 μm and a peak exists in the crystal grain size range of no less than about 12 μm and no more than about 50 μm. The silicon crystal grains whose crystal grain sizes fall within the range of no less than about 1 μm and no more than about 7.5 μm are eutectic silicon grains, whereas the silicon crystal grains whose crystal grain sizes fall within the range of no less than about 12 μm and no more than about 50 μm are primary-crystal silicon grains. Also from these results, it can be seen that smaller silicon crystal grains are formed in the prototype than in the comparative example. Incidentally, a Rockwell hardness (HRB) of the slide surface 101 of the prototype was measured to be about 70.

Next, an engine (or specifically, a 4 cycle water-cooling type gasoline engine) was assembled by using each of the prototype and comparative cylinder blocks, and the engines were subjected to an abrasion test. The slide surface of a piston to be inserted into the cylinder bore was iron-plated to a thickness of about 15 μm. The engine was operated with a revolution of about 9,000 rpm for about 10 hours.

Figure 10:
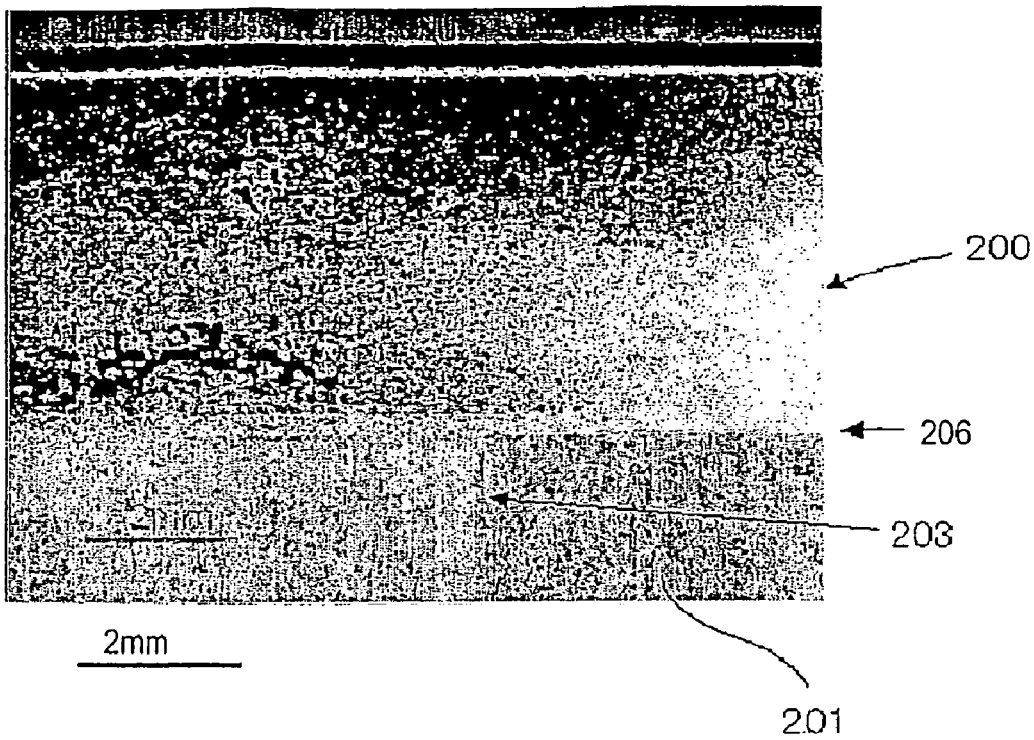
FIG. 10 is an enlarged photograph of the slide surface of the comparative cylinder block after being subjected to an abrasion test.

FIG. 10 shows an enlarged photograph of the slide surface 201 of the comparative cylinder block 200 after being subjected to an abrasion test. As shown in FIG. 10, prominent scratches 203 were left on the slide surface 201, throughout the region below a top dead center 206 of the piston ring, indicative of the poor durability of the comparative cylinder block 200.

Figure 11:
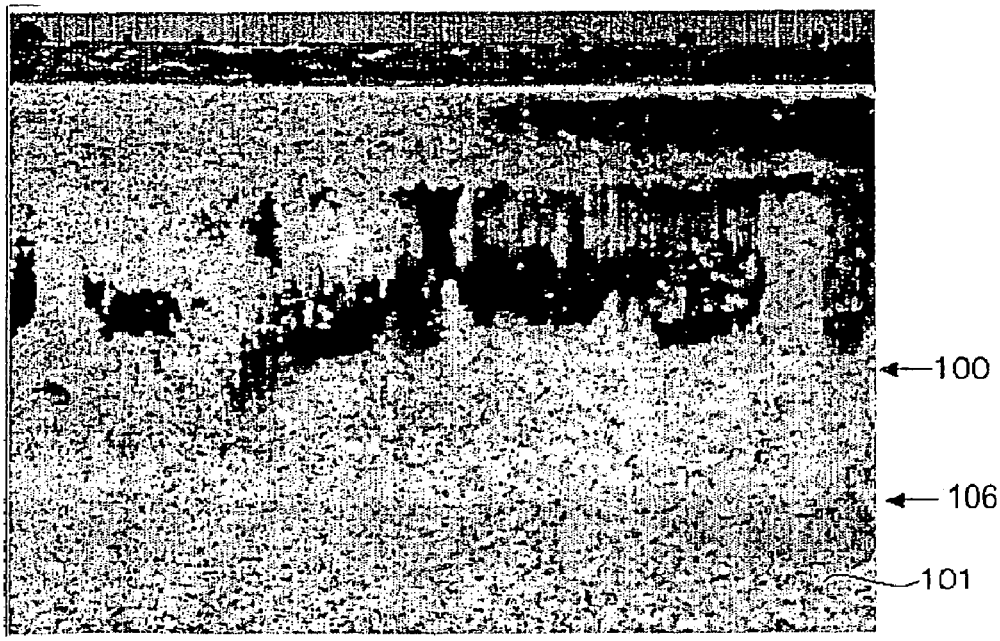
FIG. 11 is an enlarged photograph of the slide surface of the prototype cylinder block after being subjected to an abrasion test.

FIG. 11 shows an enlarged photograph of the slide surface 101 of the prototype cylinder block 100 after being subjected to an abrasion test. As shown in FIG. 11, no scratches were left on the slide surface 101 in the region below a top dead center 106 of the piston ring, indicative of the excellent durability of the prototype cylinder block 100.

As can be seen even from the above results alone, in the case of sand mold casting, no particular cooling of the cylinder bore forming portion is performed, and the cooling rate of the area of the slide surface is uncontrolled, so that the silicon crystal grains which form on the slide surface become gigantic, thus lowering the durability of the cylinder block. This is also true of conventional die casting using a die. In a mass production step using die casting, heat is likely to remain in the cylinder bore forming portion of the die, thus allowing the silicon crystal grains to become gigantic. On the other hand, in the production method of the present preferred embodiment, the cooling rate of the area of the slide surface is controlled so as to be within a predetermined range. Therefore, silicon crystal grains of a preferable average crystal grain size (or a preferable grain size distribution) are formed on the slide surface, whereby the abrasion resistance and strength of the cylinder block can be greatly improved.

Figure 12:
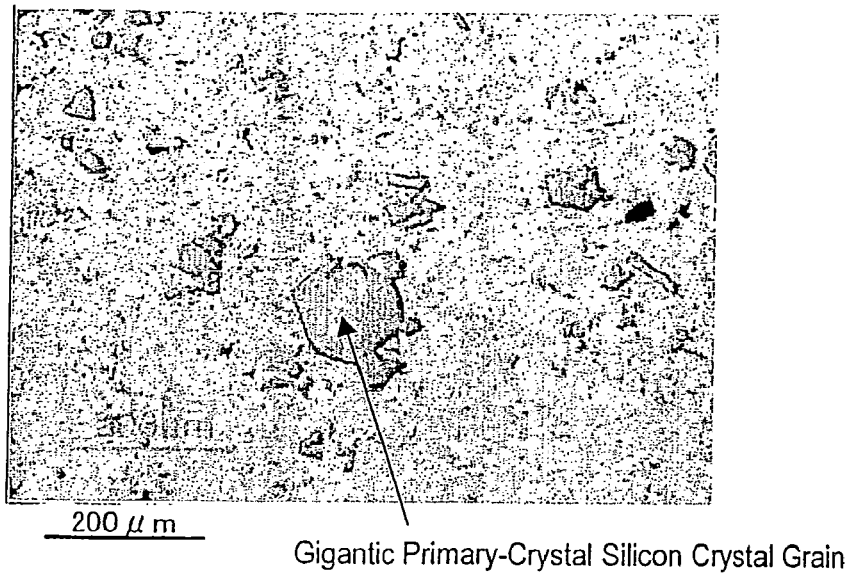
FIG. 12 is a photograph showing a silicon crystal grain which has become gigantic due to a micronization effect of phosphorus being hindered by calcium.

From the standpoint of preventing the silicon crystal grains from becoming gigantic, as already described, it is also preferable to prescribe the calcium content to be equal to or less than about 0.01 wt %. The calcium in the aluminum alloy forms a compound with phosphorus, which should function as a micronizing agent for the silicon crystal grains, and thus undermines the micronization effect of phosphorus. Therefore, as shown in FIG. 12, the primary-crystal silicon grains may become gigantic when the aluminum alloy contains more than about 0.01 wt % calcium. On the other hand, if the calcium content is equal to or less than about 0.01 wt %, the silicon crystal grain micronization effect introduced by phosphorus can be obtained more securely.

Figure 13:
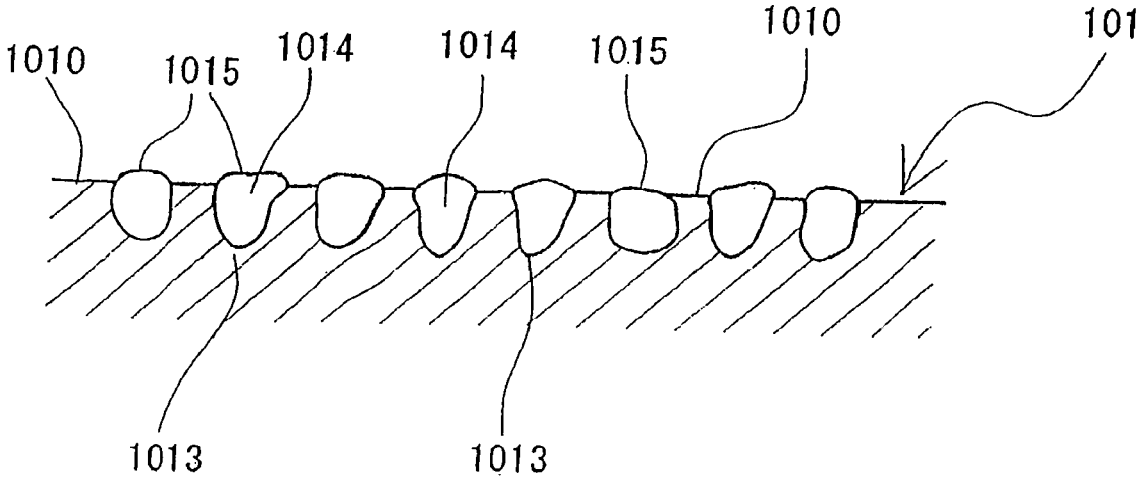
FIG. 13 is a cross-sectional view schematically showing a mechanism as to how lubricant may be retained in oil pockets on the slide surface.

Moreover, if minute silicon crystal grains are dispersed uniformly on the slide surface, the oil pockets to be formed between the silicon crystal grains also become small, thus enabling secure retention of a lubricant in the oil pockets, resulting in improved lubricity and improved abrasion resistance. As schematically shown in FIG. 13, on the slide surface 101, silicon crystal grains 1010 protrude from the aluminum solid solution (matrix) 1013 containing copper and the like, thus allowing a lubricant 1015 to be retained in dents 1014 between the silicon crystal grains 1010. By allowing minute silicon crystal grains to be uniformly dispersed and ensuring that the diameter of the dents 1014 is in the range of no less than about 1 μm and no more than about 7.5 μm, a more secure lubricant retention is enabled due to surface tension, thus making for improved lubricity and abrasion resistance.

Next, in order to ascertain the relationship between the cooling rate for the area of the slide surface and the average crystal grain size and abrasion resistance of the silicon crystal grains, a plurality of cylinder blocks were produced under the same conditions as those for the above-described prototype, while varying the cooling rate for the area of the slide surface.

An engine was assembled by using each of the plurality of cylinder blocks thus produced, and an abrasion test was performed. As a result, it has been confirmed that hardly any scratches occur in the cylinder blocks which were cast under the condition that the cooling rate was no less than about 4° C./sec and no more than about 50° C./sec, thus indicative of good abrasion resistance.

Moreover, with respect to those cylinder blocks which were cast under the condition that the cooling rate was no less than about 4° C./sec and no more than about 50° C./sec, the slide surface was observed with a metallurgical microscope. As a result, it has been confirmed that the average crystal grain size of the primary-crystal silicon crystal grain on the slide surface was no less than about 12 μm and no more than about 50 μm, and that the eutectic silicon grains had an average crystal grain size of no more than about 7.5 μm. The Rockwell hardness (HRB) of the slide surface was in the range of no less than about 60 and no more than about 80.

Figure 14A:
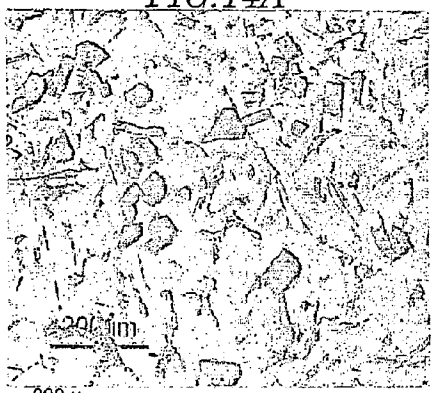
FIGS. 14A to 14E are metallurgical microscope photographs each showing a slide surface of a cylinder block, the cylinder blocks having been cast under respectively different cooling rate conditions.
Figure 14B:
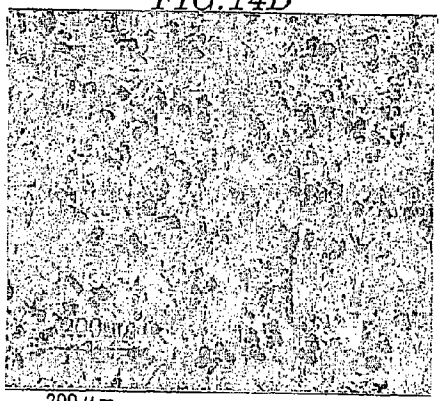
Figure 14C:
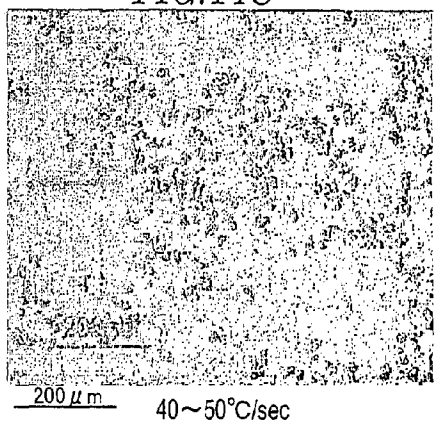
Figure 14D:
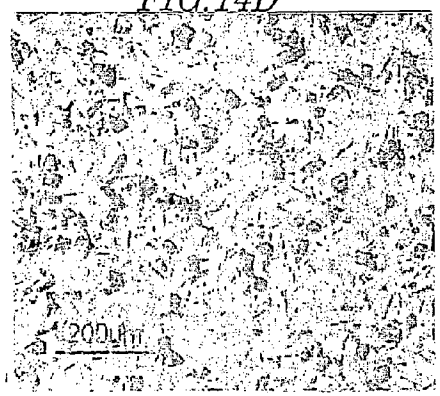
Figure 14E:
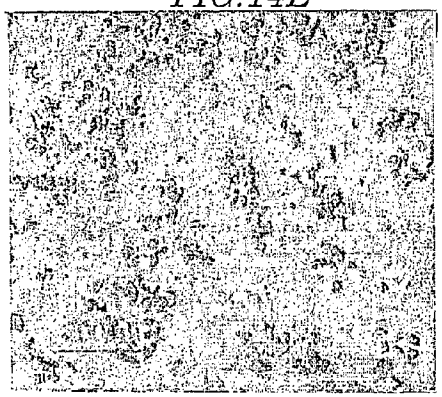

FIGS. 14A to 14E show changes in the average crystal grain size of the primary-crystal silicon grains and the vacancy ratio when the cooling rate was varied. As shown in FIG. 14A, when the cooling rate was equal to or less than about 1° C./sec, the average crystal grain size was as large as about 56.5 μm, indicative of the gigantic size of the primary-crystal silicon grains. On the other hand, when the cooling rate was no less than about 4° C./sec and no more than about 50° C./sec, as shown in FIGS. 14B to 14E, the primary-crystal silicon grains had an average crystal grain size in the range of no less than about 12 μm and no more than about 50 μm.

Moreover, an engine was assembled by using a cylinder block which had been cast under the condition that the cooling rate for the slide surface was faster than about 50° C./sec, and an abrasion test was performed, which revealed scratches all over the slide surface. The slide surface was observed with a metallurgical microscope, which revealed that the primary-crystal silicon grains had an average crystal grain size of about 10 μm or less. No eutectic silicon grains were observed.

Figure 15:
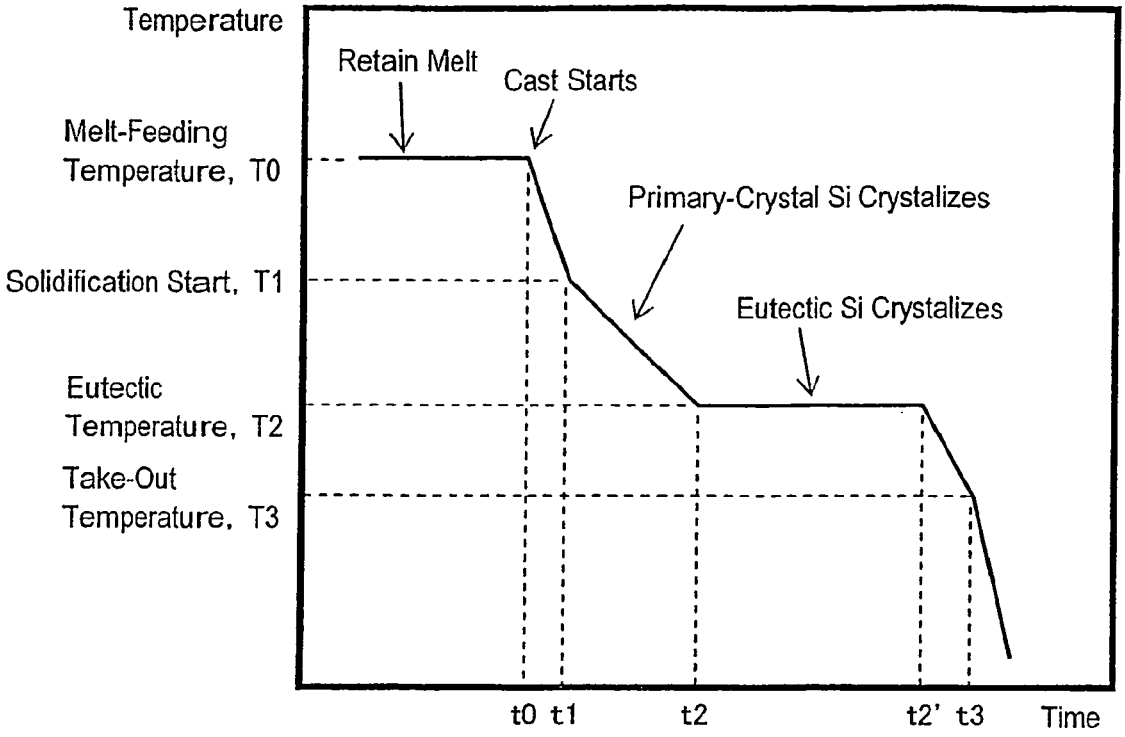
FIG. 15 is a graph showing a relationship between temperature and time after a casting process is begun.

Actually, the cooling rate does not stay constant from the beginning to end of the casting process. FIG. 15 shows a relationship between temperature and time after a casting process is begun. In the present specification, the cooling rate in the casting process is defined as (T0-T3)/(t3-t0), based on a melt-feeding temperature T0, a take-out temperature T3, a cast start time t0, and a take-out time t3. Table 2 below shows an exemplary relationship between the cooling rate and the melt-feeding temperature, take-out temperature, and cycle time.

TABLE 2

| melt-feeding temperature (° C.) | take-out temperature (° C.) | cycle time (sec) | cooling rate (° C./sec) |
|---|---|---|---|
| 750 | 500 | 10 | 25 |
| 750 | 500 | 60 | 4 |
| 750 | 300 | 10 | 45 |
| 750 | 300 | 60 | 8 |
| 800 | 500 | 10 | 30 |
| 800 | 500 | 60 | 5 |
| 800 | 300 | 10 | 50 |
| 800 | 300 | 60 | 8 |

The size of the primary-crystal silicon grains is determined as (T1−T2)/(t2−t1), based on a solidification start temperature T1, a eutectic temperature T2, a solidification start time t1, and a time t2 at which the eutectic temperature is reached. On the other hand, the size of the eutectic silicon grains is determined as t2'-t2, based on a time t2' at which the crystallization of the eutectic silicon grains ends. In general, as the size of the primary-crystal silicon grains increases, the size of the eutectic silicon grains also increases; as the size of the primary-crystal silicon grains decreases, the size of the eutectic silicon grains also decreases.

As described above, the cylinder block of various preferred embodiments of the present invention has excellent abrasion resistance and strength, and therefore is suitably used for various engines including engines for automotive vehicles. In particular, the cylinder block of the present invention is suitably used for an engine which is operated at a high revolution, e.g., an engine of a motorcycle, and can greatly improve the durability of the engine.

Figure 16:
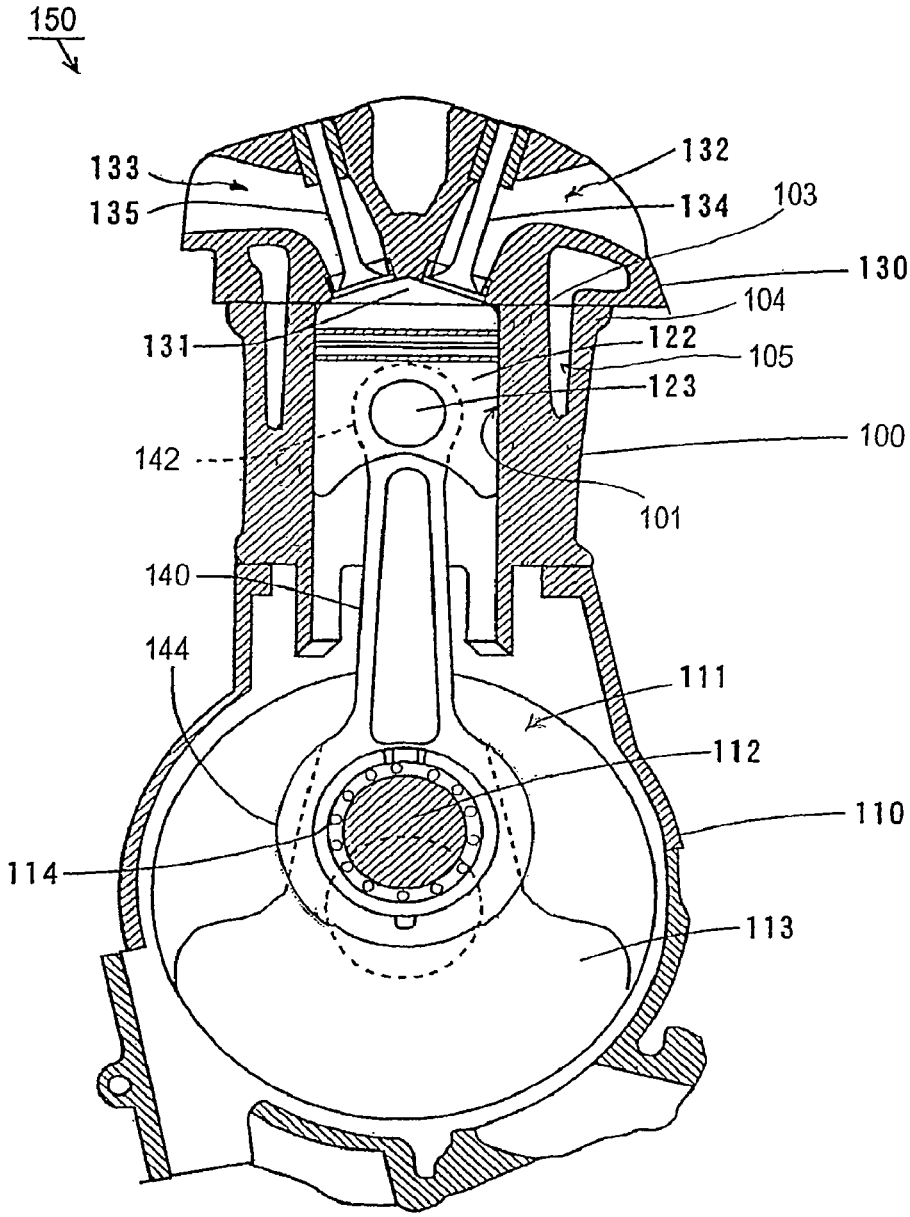
FIG. 16 is a cross-sectional view schematically showing an engine 150 having the cylinder block 100.

FIG. 16 shows an exemplary engine 150 incorporating the cylinder block 100 of a preferred embodiment of the present invention. The engine 150 includes a crankcase 110, the cylinder block 100, and a cylinder head 130.

In the crankcase 110, a crankshaft 111 is accommodated. The crankshaft 111 includes a crankpin 112 and a crankweb 113.

Above the crankcase 110 is provided the cylinder block 100. A piston 122 is inserted in the cylinder bore of the cylinder block 100. The slide surface of the piston 122 is iron-plated, and has a surface hardness which is greater than that of the slide surface 101 of the cylinder block 100. Note that the slide surface of the piston 122 may be coated with a solid lubricant. In this case, the slide surface of the piston 122 may have a surface hardness lower than that of the slide surface of the cylinder block 100. The choice as to which one of the slide surface of the piston 122 and the slide surface 101 of the cylinder block 100 should have a higher surface hardness (i.e., which one should have a higher abrasion resistance) is to be made based on various conditions (e.g., model, destination, cost, and the like).

No cylinder sleeve is placed in the cylinder bore, and the inner surface of the cylinder bore wall 103 of the cylinder block 100 is not plated. In other words, the primary-crystal silicon grains 1011 are exposed on the surface of the cylinder bore wall 103. Note that a cylinder block having a plated cylinder bore wall might be used in combination with a piston having a slide surface on which silicon crystal grains have formed in the aforementioned mode or style. However, the cooling performance will be lower in that case, while abrasion resistance can be secured.

Above the cylinder block 100 is provided the cylinder head 130. The cylinder head 130 forms a combustion chamber 131 together with the piston 122 of the cylinder block 100. The cylinder head 130 includes an intake port 132 and an exhaust port 133. In the intake port 132, an intake valve 134 for supplying a gas mixture into the combustion chamber 131 is provided. In the exhaust port, an exhaust valve 135 for discharging air from the combustion chamber 131 is provided.

The piston 122 and the crankshaft 111 are connected via a connection rod 140. Specifically, a piston pin 123 of the piston 122 is inserted in a throughhole in a small end 142 of the connection rod 140, and the crankpin 112 of the crankshaft 111 is inserted in a throughhole in a big end 144 of the connection rod 140, whereby the piston 122 and the crankshaft 111 are connected together. Between the inner surface of the throughhole in the big end 144 and the crankpin 112 is provided a roller bearing 114.

Since the engine 150 shown in FIG. 16 incorporates the cylinder block 100 of an above-described preferred embodiment of the present invention, the engine 150 has excellent durability. Since the cylinder block 100 of various preferred embodiments of the present invention is characterized by a high abrasion resistance and strength of the slide surface 101, there is no need for a cylinder sleeve. Therefore, engine production steps can be simplified, the engine weight can be reduced, and the cooling performance can be improved. Furthermore, since it is unnecessary to perform plating for the inner surface of the cylinder bore wall 103, it is also possible to reduce production cost.

Figure 17:
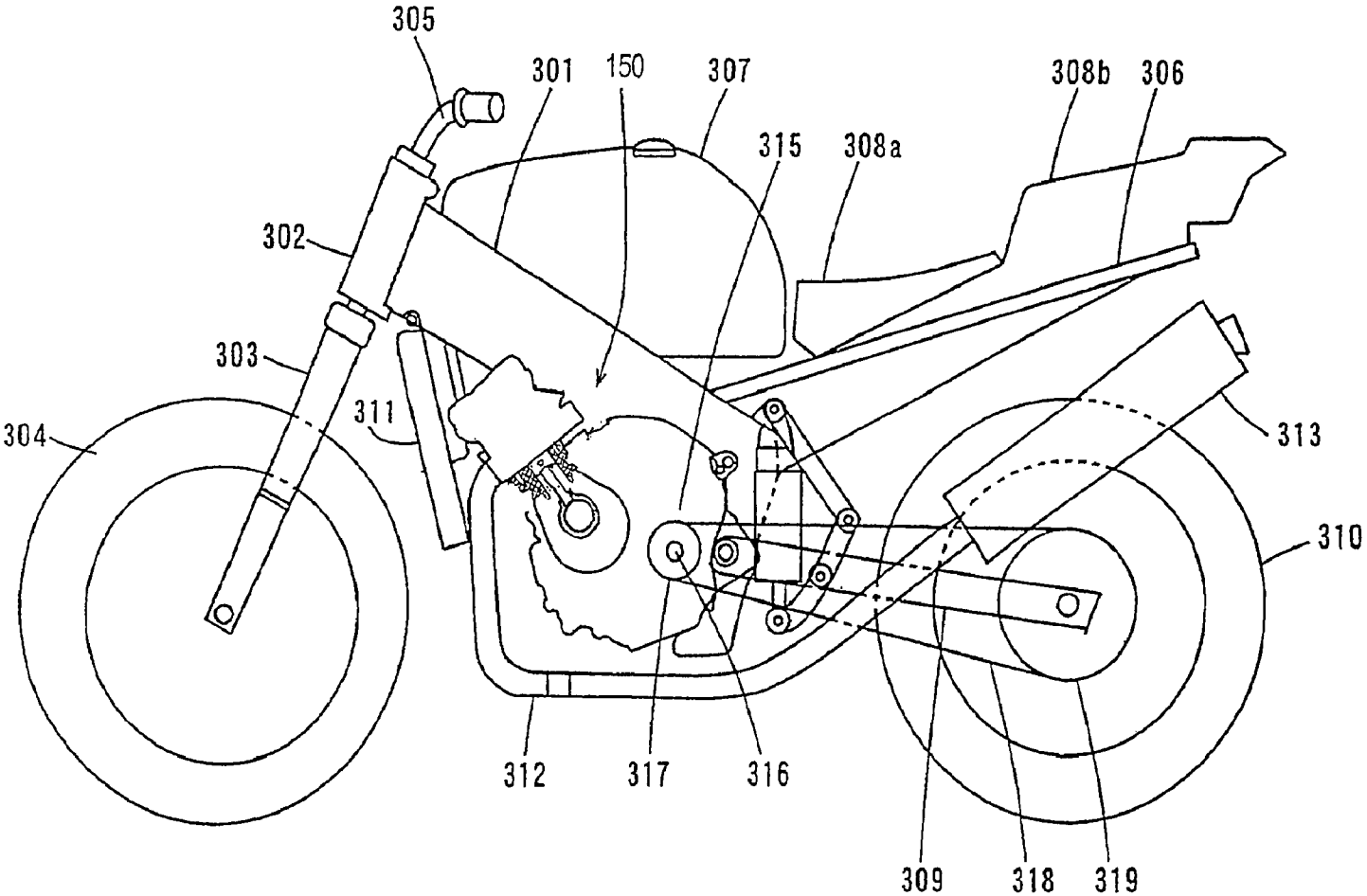
FIG. 17 is a side view schematically showing a motorcycle having the engine 150 shown in FIG. 16.

FIG. 17 shows a motorcycle incorporating the engine 150 shown in FIG. 16.

In the motorcycle shown in FIG. 17, a head pipe 302 is provided at a front end of a main-body frame 301. To the head pipe 302, a front fork 303 is attached so as to be capable of swinging in right and left directions of the motorcycle. At a lower end of the front fork 303, a front wheel 304 is supported so as to be capable of rotating.

A seat rail 306 is attached to the main-body frame 301 so as to extend in the rear direction from an upper rear end thereof. A fuel tank 307 is provided above the main-body frame 301, and a main seat 308*a* and a tandem sheet 308*b* are provided on the seat rail 306.

At the rear end of the main-body frame 301, a rear arm 309 which extends in the rear direction is attached. At a rear end of the rear arm 309, a rear wheel 310 is supported so as to be capable of rotating.

In a central portion of the main-body frame 301, the engine 150 as shown in FIG. 16 is held. The cylinder block 100 of any of the preferred embodiments of the present invention is used in the engine 150. A radiator 311 is provided in front of the engine 150. An exhaust pipe 312 is connected to an exhaust port of the engine 150, and a muffler 313 is attached to a rear end of the exhaust pipe 312.

A transmission 315 is coupled to the engine 150. A driving sprocket wheel 317 is attached to an output axis 316 of the transmission 315. The driving sprocket wheel 317 is coupled to a rear wheel sprocket wheel 319 of the rear wheel 310, via a chain 318. The transmission 315 and the chain 318 function as a transmission mechanism for transmitting motive power which is generated by the engine 150 to the driving wheel.

The motorcycle shown in FIG. 17 incorporates the engine 150 in which the cylinder block 100 of any of the preferred embodiments of the present invention is used, and therefore provides preferable performances.

According to various preferred embodiments of the present invention, there is provided an engine component having excellent abrasion resistance and strength, and a method for producing the same.

The engine component according to preferred embodiments of the present invention can be suitably used for various engines including engines for automotive vehicles, and particularly suitably used for engines which are operated at a high revolution.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed:

1. An engine component composed of an aluminum alloy containing silicon, comprising:

a plurality of silicon crystal grains located on a slide surface; wherein the engine component is a cast article;

the plurality of silicon crystal grains have a grain size distribution having at least two peaks; and the at least two peaks include a first peak existing in a crystal grain size range of no less than about 1 μm and no more than about 7.5 μm and a second peak existing in a crystal grain size range of no less than about 12 μm and no more than about 50 μm; wherein the aluminum alloy contains no less than about 18 wt % silicon and no more than about 22 wt % of silicon.

2. The engine component of claim 1, wherein, in any arbitrary rectangular region of the slide surface having an approximate area of 800 μm×1000 μm, the number of circular regions having a diameter of about 50 μm and not containing any silicon crystal grains of a crystal grain size of about 0.1 μm or more is equal to or less than five.

3. The engine component of claim 1, wherein the aluminum alloy contains: no less than about 73.4 wt % and no more than about 79.6 wt % of aluminum; and no less than about 2.0 wt % and no more than about 3.0 wt % of copper.

4. The engine component of claim 1, wherein the aluminum alloy contains no less than about 50 wtppm and no more than about 200 wtppm of phosphorus and no more than about 0.01 wt % of calcium.

5. The engine component of claim 1, wherein the slide surface has a Rockwell hardness (HRB) of no less than about 60 and no more than about 80.

6. An engine comprising the engine component of claim 1.

7. An automotive vehicle comprising the engine of claim 6.

8. A cylinder block composed of an aluminum alloy containing: no less than about 73.4 wt % and no more than about 79.6 wt % of aluminum; no less than about 18 wt % and no more than about 22 wt % of silicon; and no less than about 2.0 wt % and no more than about 3.0 wt % of copper, the cylinder block comprising:

a plurality of primary-crystal silicon grains located on a slide surface arranged to come in contact with a piston, and a plurality of eutectic silicon grains disposed between the plurality of primary-crystal silicon grains; wherein the cylinder block is a cast article; and the plurality of primary-crystal silicon grains have an average crystal grain size of no less than about 12 μm and no more than about 50 μm, and the plurality of eutectic silicon grains have an average crystal grain size of no more than about 7.5 μm;

the aluminum alloy contains: no less than about 50 wtppm and no more than 200 wtppm of phosphorus; and no more than about 0.01 wt % of calcium; and the slide surface has a Rockwell hardness (HRB) of no less than about 60 and no more than about 80.

9. An engine comprising the cylinder block of claim 8, and a piston having a slide surface whose surface hardness is higher than that of the slide surface of the cylinder block.

10. An automotive vehicle comprising the engine of claim 9.

* * * * *